US006206094B1

(12) United States Patent
Smith, Jr.

(10) Patent No.: US 6,206,094 B1
(45) Date of Patent: Mar. 27, 2001

(54) LAUNCHING TOOL FOR OBJECTS DOWNHOLE

(75) Inventor: Sidney K. Smith, Jr., Conroe, TX (US)

(73) Assignee: Baker Hughes Incorporated

( * ) Notice: Subject to any disclaimer, the term of this patent is extended or adjusted under 35 U.S.C. 154(b) by 0 days.

(21) Appl. No.: 09/184,103

(22) Filed: Nov. 2, 1998

(51) Int. Cl.[7] ..... E21B 33/16
(52) U.S. Cl. ..... 166/70; 166/192; 15/104.062
(58) Field of Search ..... 15/104.062; 166/285, 166/290, 291, 70, 153, 155, 156, 192, 193, 194, 173, 383, 154

(56) References Cited

U.S. PATENT DOCUMENTS

| | | | |
|---|---|---|---|
| 4,047,566 | 9/1977 | Duke . | |
| 4,756,365 | 7/1988 | Schneider . | |
| 5,311,940 | 5/1994 | LaFleur | 166/152 |
| 5,361,835 | 11/1994 | LaFleur | 166/152 |
| 5,435,386 | 7/1995 | LaFleur | 166/156 |
| 5,890,537 | 4/1999 | Lavaure et al. | 166/285 |

FOREIGN PATENT DOCUMENTS

| | | |
|---|---|---|
| 85303891 | 6/1985 | (EP) . |
| 91300796 | 1/1991 | (EP) . |
| 2240563 | 8/1991 | (GB) . |

*Primary Examiner*—Christopher J. Novosad
(74) *Attorney, Agent, or Firm*—Duane, Morris & Heckscher LLP

(57) ABSTRACT

The invention comprises a tool for launching objects downhole, such as one or more plugs in a desired sequence. The movements leading to the release of the individual plugs are regulated by virtue of displacement of oil through at least one orifice. The wiper plugs are retained in the tool until such time as they are physically displaced beyond the lower end of the tool. The biased retainers holding the plugs within the tools are released upon a predetermined movement of the plugs beyond the lower end of the tool. If the retaining mechanism for the plug does not automatically release upon sufficient extension of the wiper plug from the tool, a pressure assist can be used to launch any given plug. The darts used to move an actuating piston to release the plugs are separated from the plugs and retained in the tool so that they do not need to be drilled out later.

21 Claims, 29 Drawing Sheets

LAUNCHING TOOL FOR OBJECTS DOWNHOLE

FIELD OF THE INVENTION

The field of this invention relates to launching objects downhole, particularly wiper plugs used in cementing of tubulars downhole.

BACKGROUND OF THE INVENTION

Currently available designs for launching plugs downhole employ a variety of mechanical retention devices for sequential release of plugs. These devices are typically collets or a variety of shearable devices intended to sequentially release wiper plugs into a liner ahead of the cement and behind it. Typically, these devices are attached at the bottom of the liner setting tool. After the liner is properly hung, the tool is called upon to sequentially launch the wipers to facilitate the cementing of the liner through a cementing shoe. Typical of such products is the LFC four-plug system, product No. 269-27 made by Baker Oil Tools. In this device, a series of darts of different sizes engage different sized wiper plugs to pry them loose from the connection mechanism. The dart goes down with the wiper plug and must be drilled out later. A shock loading is placed on the retention mechanism as the dart lands in its respective plug. While there are many variations of these wiper plug-launching systems, the nature of the retention devices used for the wiper plugs has in the past caused some operational difficulties in a variety of different ways. In some situations, the wiper plugs would not release at all. In other situations, more than one wiper plug released when only one was intended to be released. Darts used to launch the plugs had to be drilled out.

Typically in these systems, after landing the first wiper plug, a barrier through or around the plug is broken to allow pumping of the cement before pushing the next plug down behind the cement. Plugs with breakable barriers for this purpose have been used in the past. These plugs are also typically made of soft materials so that they can be quickly drilled out after the cementing operation is concluded. Typical of such plugs are those illustrated in U.S. Pat. Nos. 5,435,386; 5,361,835; and 5,311,940.

It is an object of this invention to provide a reliable apparatus for launching objects downhole, particularly wiper plugs in the proper sequence with confidence. In describing and claiming the invention, references to "wiper plugs" or "plug" are intended to be broad enough to include any other objects such as "balls," as one example. This objective is accomplished by regulated movement of the various components to avoid abrupt movements due to pressure buildups normally used in delivery of wiper plugs where darts land in them in order to launch. The objective is further met by a sequential operation which can effectively launch one or a plurality of plugs in a desired sequence. Provisions are made for a pressure-assisted shear release as an emergency technique for release of the wiper plug in the event it does not automatically release for any reason. These and other objectives of the invention will become more readily understandable to one of skill in the art from a review of the preferred embodiment described below.

SUMMARY OF THE INVENTION

The invention comprises a tool for launching objects downhole, such as one or more plugs in a desired sequence. The movements leading to the release of the individual plugs are regulated by virtue of displacement of oil through at least one orifice. The wiper plugs are retained in the tool until such time as they are physically displaced beyond the lower end of the tool. The biased retainers holding the plugs within the tools are released upon a predetermined movement of the plugs beyond the lower end of the tool. If the retaining mechanism for the plug does not automatically release upon sufficient extension of the wiper plug from the tool, a pressure assist can be used to launch any given plug. The darts used to move an actuating piston to release the plugs are separated from the plugs and retained in the tool so that they do not need to be drilled out later.

DETAILED DESCRIPTION OF THE PREFERRED EMBODIMENT

Figure 1A:
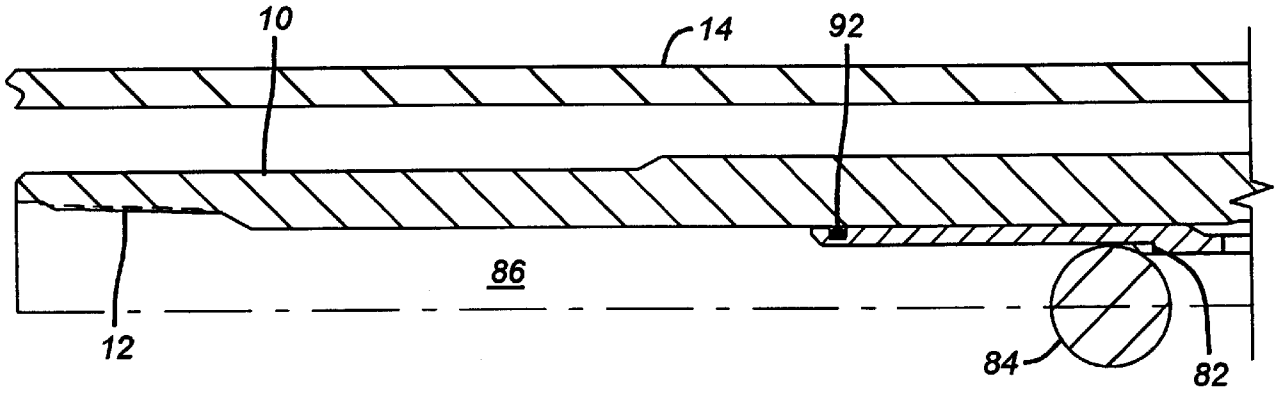
FIGS. 1*a–g* show a sectional view of the tool upon attaining the desired position with a ball dropped to obstruct a port in an actuating sleeve.

Referring to FIGS. 1*a–g*, the plug-launching tool T has a top sub 10 with a thread 12. Connected above thread 12 and not shown in the figures is the hanger mechanism for hanging the liner to the tubular through which it has just been run. The liner 14 is the one to be cemented using the tool T. Connected to the top sub 10 is body 16. Thread 18 connects body 16 to top sub 10. A bottom sub 20 (see FIG. 1*d*) is connected to body 16 at thread 22. Attached to bottom sub 20 by virtue of thread 26 is a sleeve 24. Sleeve 24 encloses wiper plugs 28 and 30 during run-in. Wiper plug 28 is attached to wiper plug 30 by virtue of pin 32 extending into groove 34, which is built into wiper plug 30. Pin 32 is biased inwardly by spring 36 but, in the position shown in FIG. 1*e*, cannot come out of groove 34 because of sleeve 24. Similarly, wiper plug 30 has a pin 38 biased inwardly by a spring 40. Sleeve 24 holds the pin 38 in a groove 42 in end connection 44, which is in turn secured to shaft 46 at thread 48. At the upper end of shaft 46, an actuating piston 50 is secured at thread 52.

Defined between shaft 46 and body 16 are sealed cavities 54, 56, and 58. Cavity 54 is sealed off by seals 60 and 62 at its lower end, respectively, against body 16 and shaft 46. Cavity 54 has an outlet port 64 which is obstructed by a "rupture disc," which is defined as any device which can obstruct the path and then open it after a predetermined pressure, chemical or other triggering event or signal is applied. In the preferred embodiment, a rupture disc 65 is employed in passage 64 so as to give good control of the predetermined pressure that needs to be applied before rupture disc 65 breaks to allow an incompressible fluid such as, for example, mineral oil, which is in cavity 54, to be pushed out of the tool T through filter 51 and replaceable orifice 67. After breakage, the size of the opening left by the broken rupture disc or the diameter of passage 64, or the opening in replaceable orifice 67, can serve as the flow restrictor for the mineral oil in cavities 54, 56 and 58. This flow restriction regulates movement of piston 50 to avoid putting pressure shocks on the formation. The upper end of the cavity 54 is defined by movable piston 66, which has peripheral seals 68 and 69 and a thru path 70, which is obstructed by a rupture disc 72. Again, as in the case with rupture disc 65 and with all the other "rupture discs" to be described in the preferred embodiment, other devices which block off a bore until a predetermined condition occurs, whereupon the bore is opened up. The preferred breakpoint for rupture disc 72 is lower than rupture disc 65. Since each floating piston 66 and 74 is in pressure balance until rupture disc 65 breaks, the set pressure of rupture disc 65 can be higher than rupture discs 72 and 80, and rupture disc 65 will break first. Cavity 56 is defined between piston 66 and movable piston 74. Piston 74 has peripheral seals 76 and 77 and a bore 78, in initially obstructed by rupture disc 80. Rupture disc 80 is preferably set to break at the same pressure as the pressure required to break rupture disc 72. This is because rupture disc 80 is in pressure balance until rupture disc 72 is broken. Cavity 56 is filled with mineral oil or any other suitable incompressible fluid. Displacement of the oil acts as a fluid damper on the actuating piston 50. Finally, cavity 58 is defined between piston 74 and actuating piston 50 and is sealed off by seal 80 against the body 16.

Referring to FIGS. 1*a* and *b*, the actuating piston 50 has a ball seat 82 to accept a ball 84 to apply pressure in passage 86. In order to allow the ball 84 to be pumped down to seat 82, an opening 88 in actuating piston 50 is aligned with lateral port 90 in top sub 10 so that fluid can pass around the tool T and deliver the ball 84 to the seat 82. Annular gap 94 allows the fluid to bypass the tool T after emerging from port 90. Pressuring on ball 84 sets a liner hanger (not shown) and releases a running tool (not shown) and shifts actuating piston 50 without releasing wiper plug 28.

Referring again to FIGS. 1*e* and *f*, it can be seen that the wiper plugs 28 and 30 have been pushed into sleeve 24 with their wiping elements 95 and 96 compressed. The wiper plug 28 has a pair of O-rings 98 and 100 which seal in bore 102 (see FIG. 8*h*) when the wiper plug 28 is caught on its shoulder 104. This occurs near the cementing shoe (not shown) which is just below stop ring 106 shown in FIG. 8*h*. Referring again to FIGS. 1*e–f*, it can be seen that the wiper plug 28 has a breakable barrier 108 which again can be a rupture disc or any other assembly which opens up passage 110 in wiper 28 at a predetermined applied differential pressure or other condition.

Sleeve 24 also includes a passage 112 which allows the space above plug 28 to fill with wellbore fluids at the pressure for the depth where the tool T is found to avoid collapse of sleeve 24 due to trapped atmospheric pressure internally.

The wiper plug 30 has an elongated seal 114 of the type described in U.S. Pat. No. 5,611,547. Seal 114 generally sees higher differential pressures than seals 98 and 100. Accordingly, seal 114 is uniquely configured to deal with high differential pressures and temperatures which could be seen downhole. A large port 116 is in sleeve 24 above wiper plug 30. The purpose of this port is to prevent collapse of sleeve 24 due to differential pressures resulting from any trapped atmospheric pressure liquid in cavity 118. With the passage 116, cavity 118 is at the surrounding wellbore pressures and flow can come in to cavity 118 as the plugs 28 and 30 are displaced out of sleeve 24.

Figure 2A:
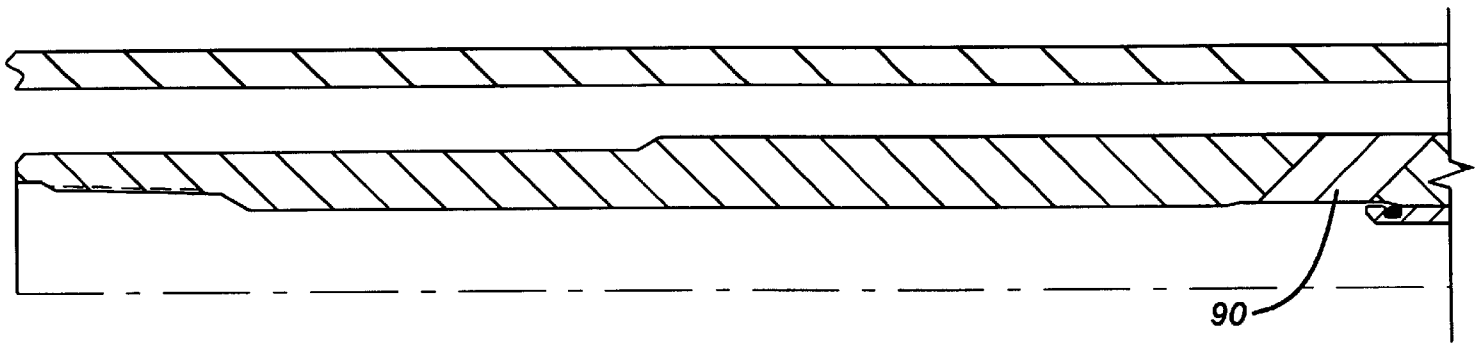
FIGS. 2*a–g* show the actuating sleeve shifted, breaking a rupture disc in the tool.
Figure 1B:
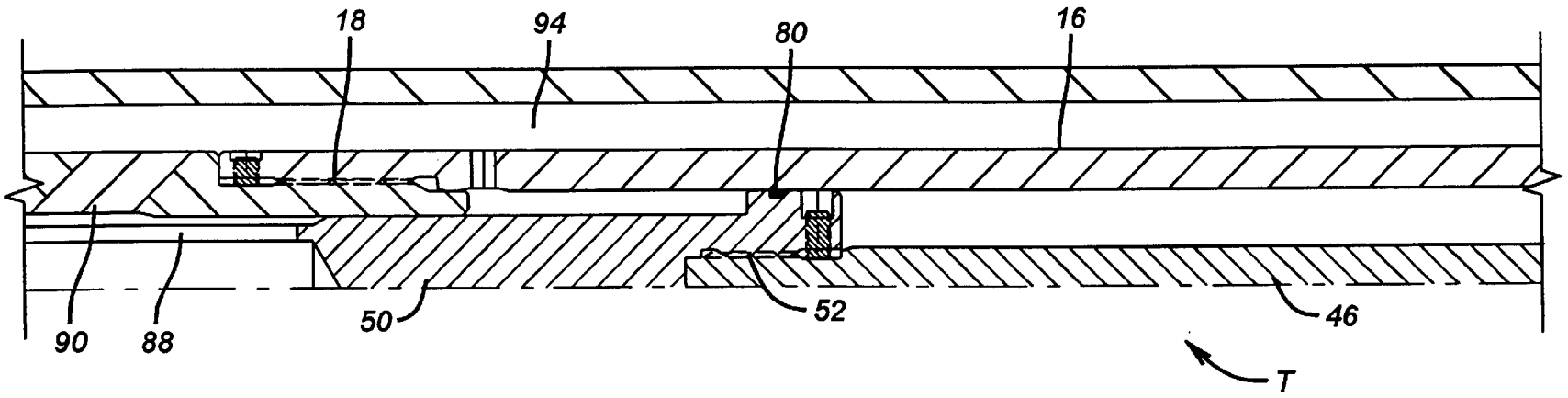
Figure 2B:
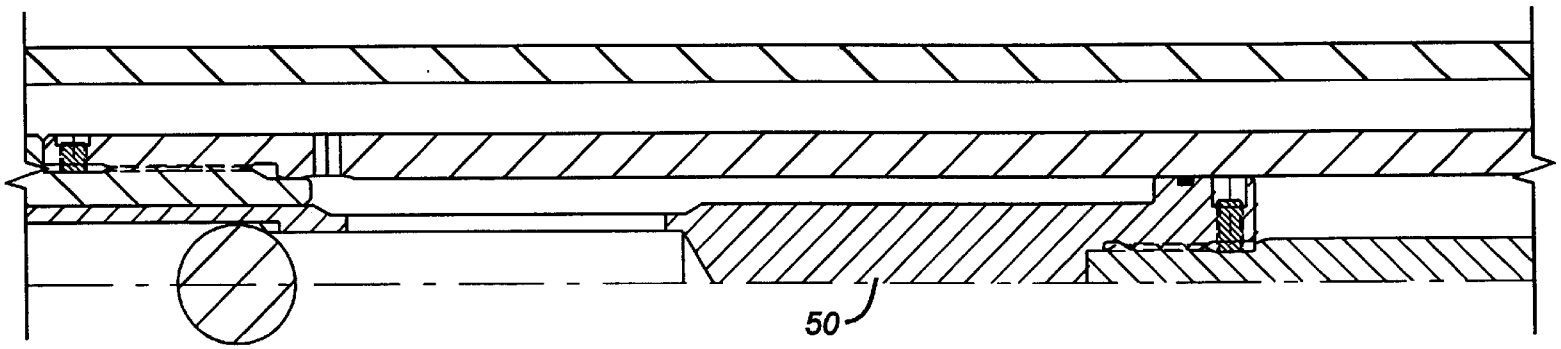
Figure 1C:
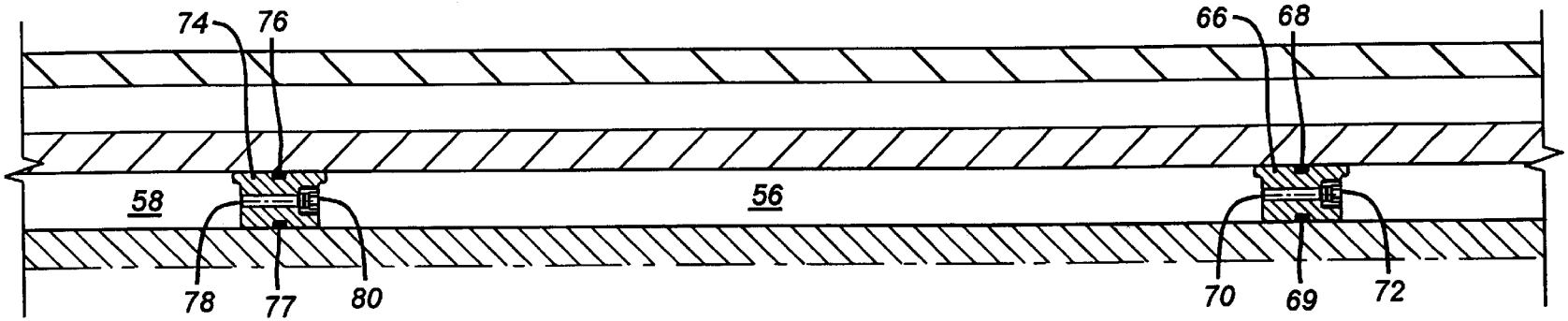
Figure 2C:
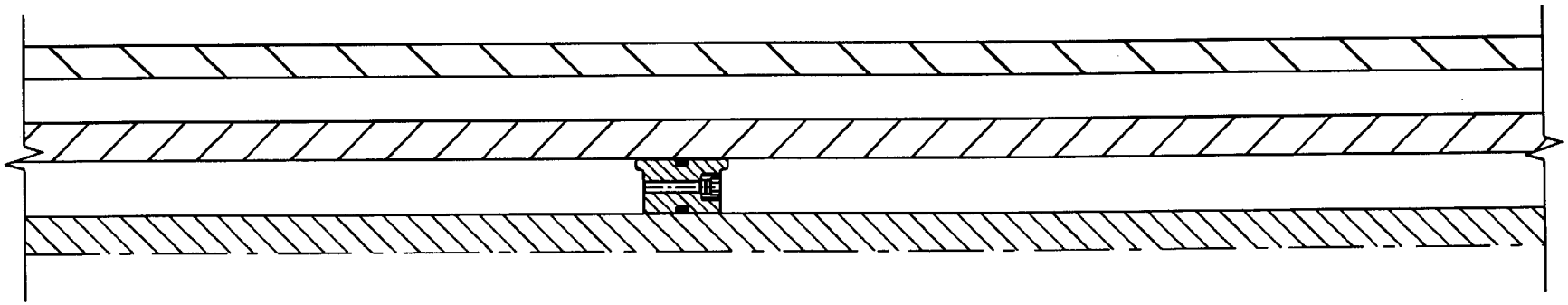
Figure 1D:
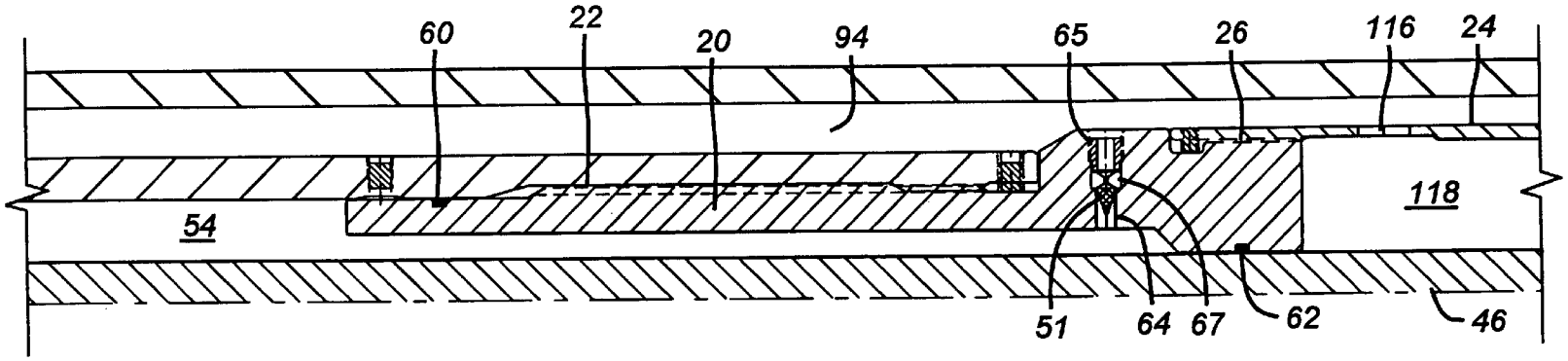
Figure 2D:
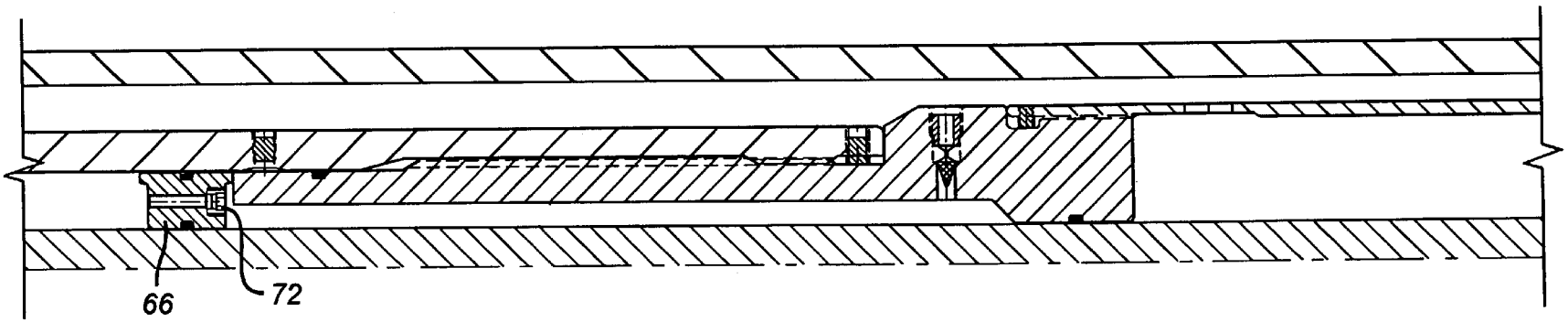
Figure 1E:
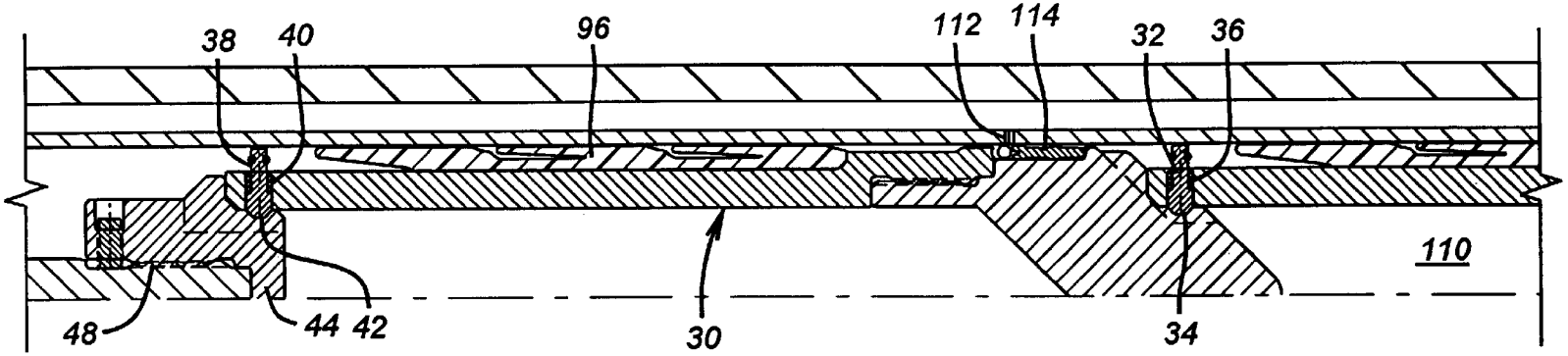
Figure 2E:
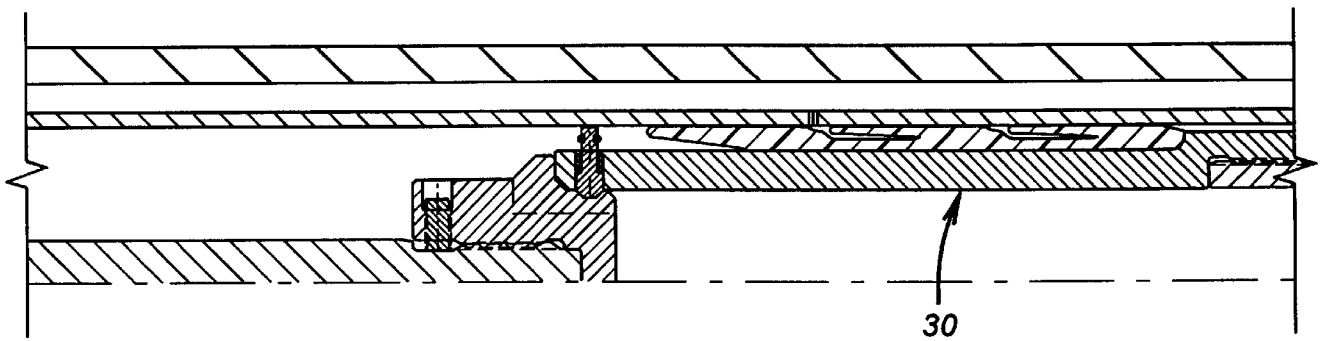
Figure 1F:
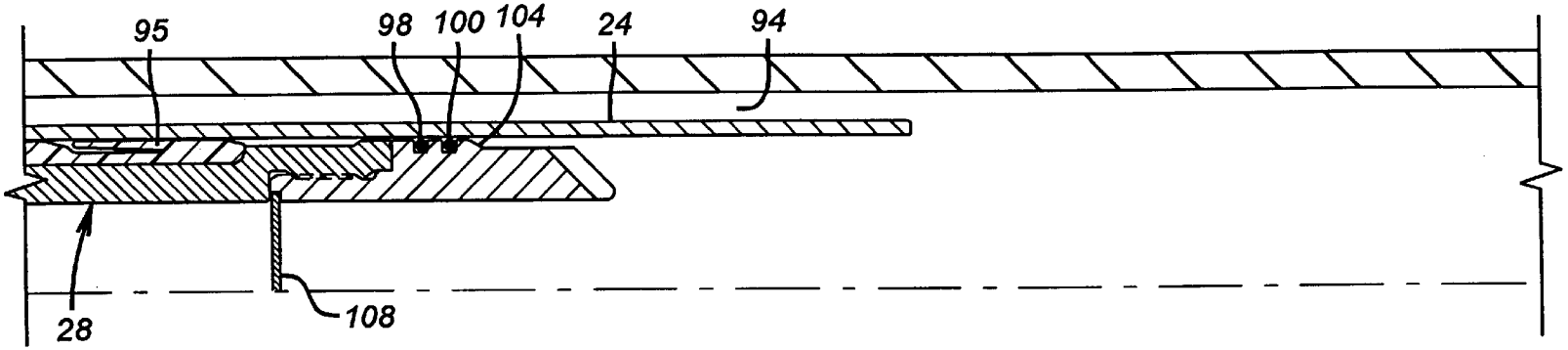
Figure 2F:
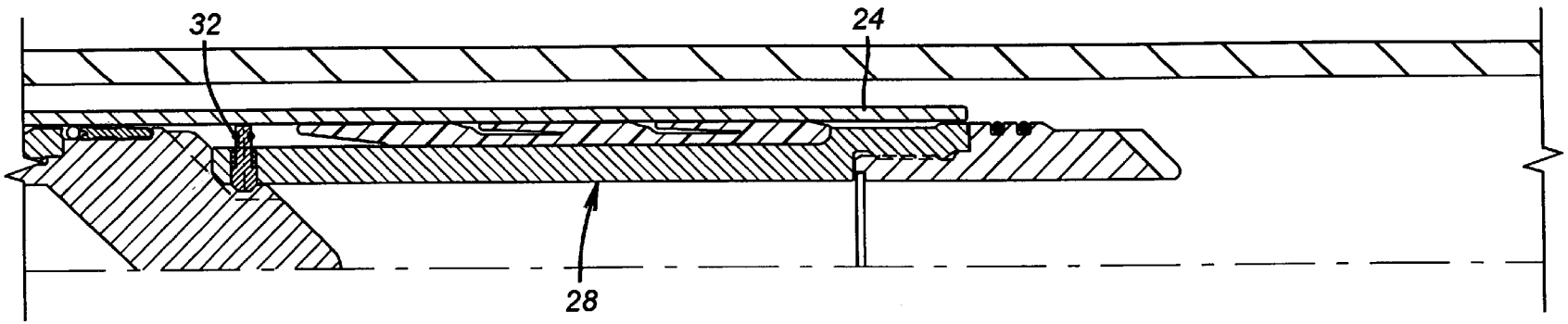
Figure 1G:
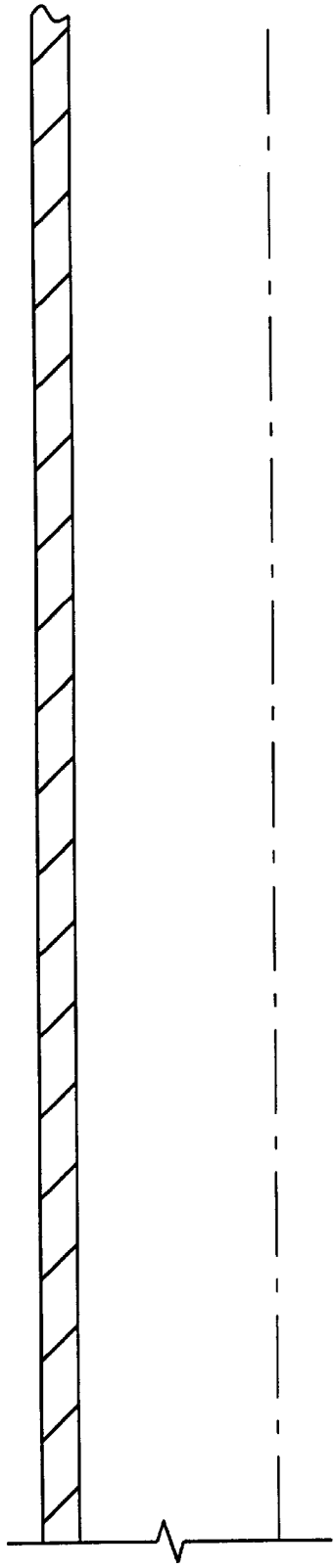
Figure 2G:
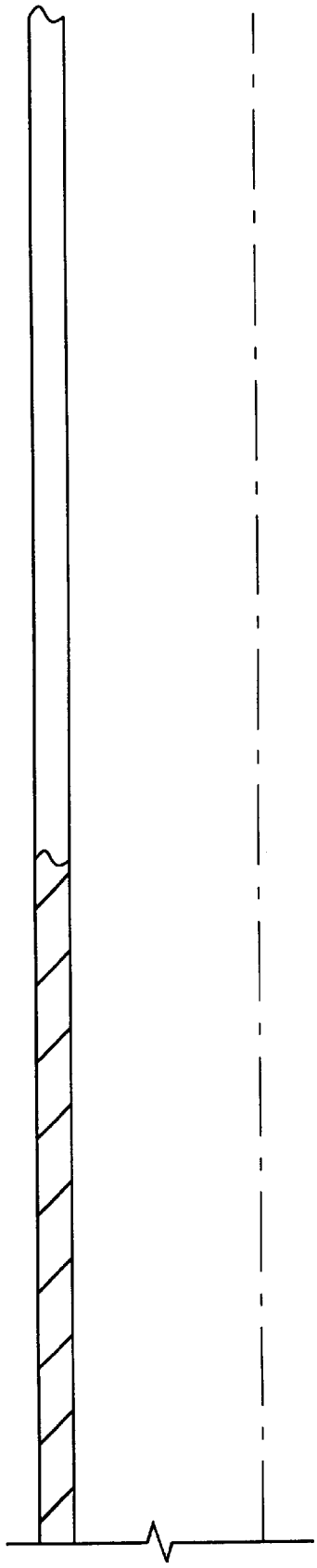

The principal components of the plug-launching tool T having been described, its operation will now be described in more detail. As shown in FIG. 1, the initial step is to pump ball 84 down against seat 82 to allow pressure in passage 86 to shift the actuating piston 50. This same pressure buildup sets the liner hanger (not shown) and releases the running tool (not shown). Pressure applied to actuating piston 50 increases the pressure in cavities 54, 56, and 58. Again recalling that pistons 66 and 74 are floating, the applied pressure due to attempt to move the actuating piston 50 downwardly results in an increase in pressure behind rupture disc 65 which is in outlet port 64. Eventually, the rupture disc 65 breaks (after the liner hanger, not shown, sets), allowing the fluid-filled cavity 54 to decrease in volume as its contents are slowly pushed through the ruptured disc 65 and orifice 67. As fluid is displaced out of cavity 54 allowing its volume to decrease at a regulated rate due to the size of the orifice 67, the actuating piston 50, along with the shaft 46 connected thereto, moves the wiper plugs 28 and 30 at a controlled rate to the position shown in FIGS. 2*d–f*. At this time, pin 32 is still retained in sleeve 24. However, the movement of the wiper plugs 28 and 30 has been gradual. In the position of FIGS. 2*d–f*, wiper plug 28 is still retained within sleeve 24 and retained to wiper plug 30.

Figure 3A:
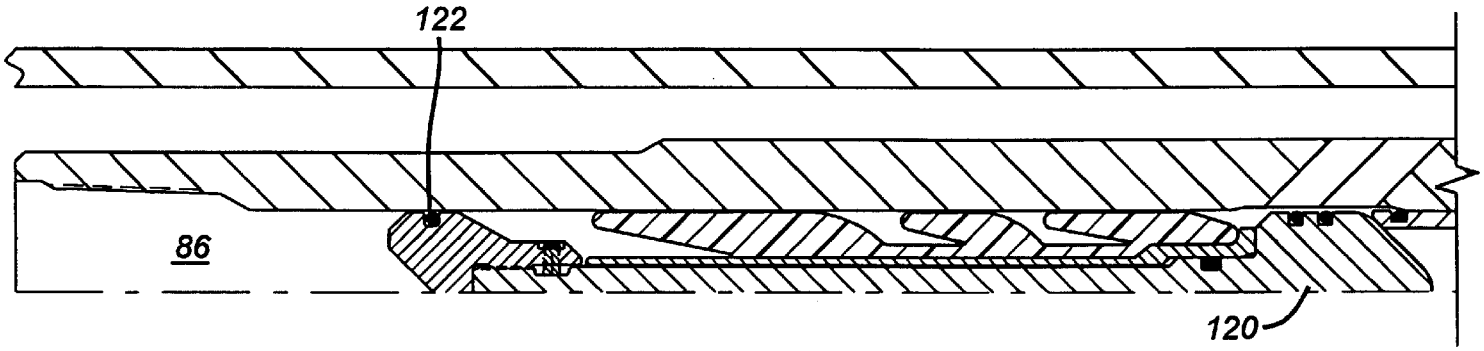
FIGS. 3*a–g* show the launching of the dart to obstruct a lateral port at the conclusion of the initial movement of the actuating sleeve.
Figure 4A:
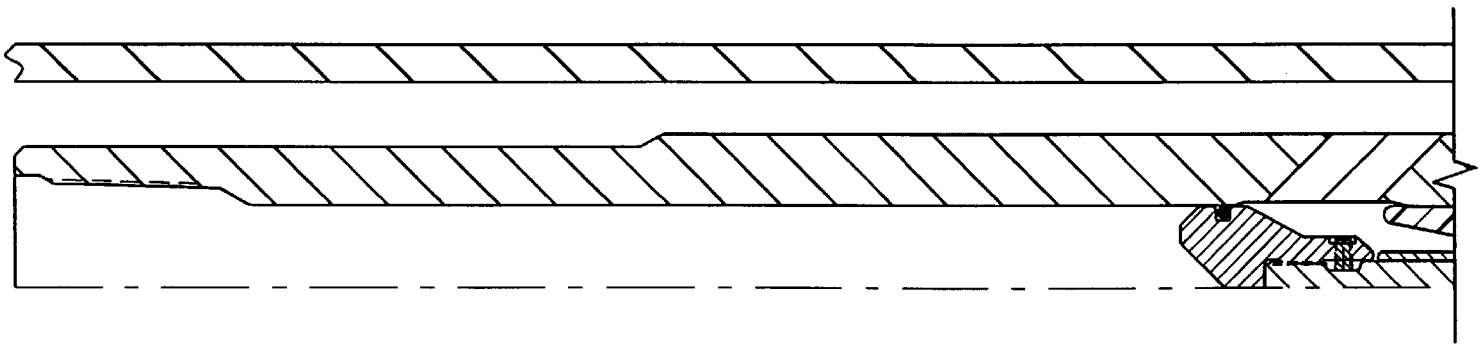
FIGS. 4*a–g* show the first wiper plug released out the bottom of the tool after further shifting of the actuating sleeve.
Figure 3B:
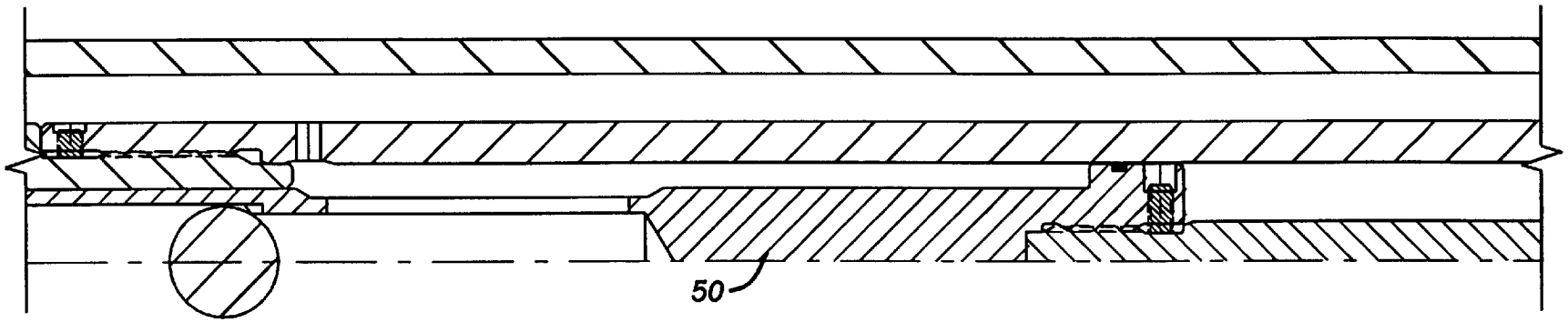
Figure 4B:
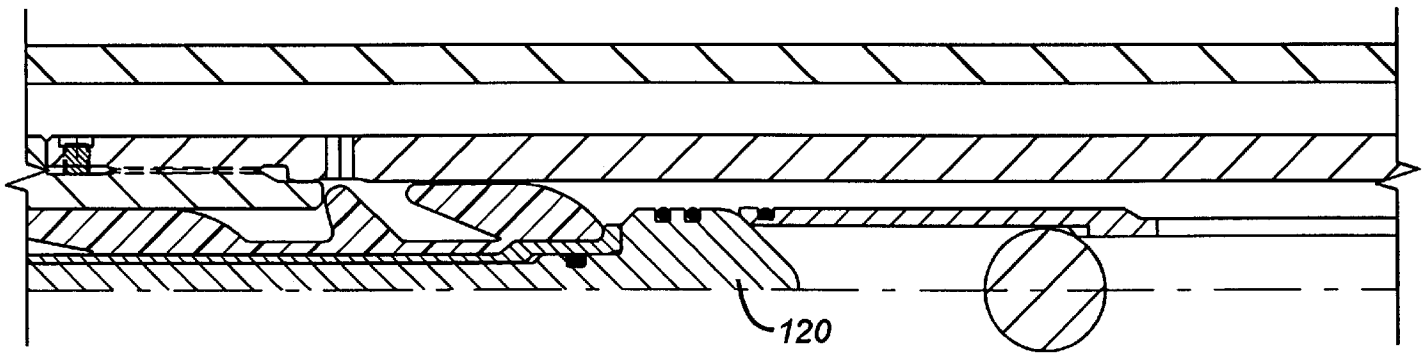
Figure 3C:
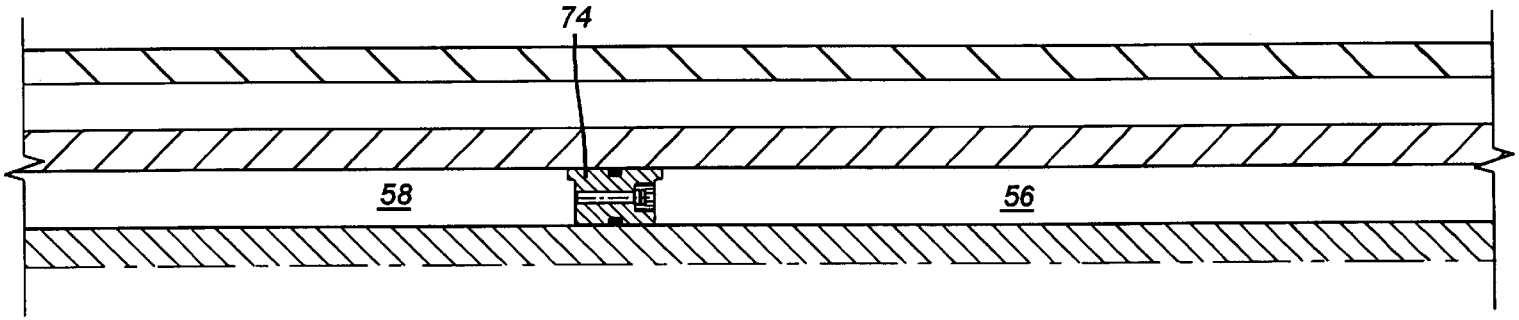
Figure 4C:
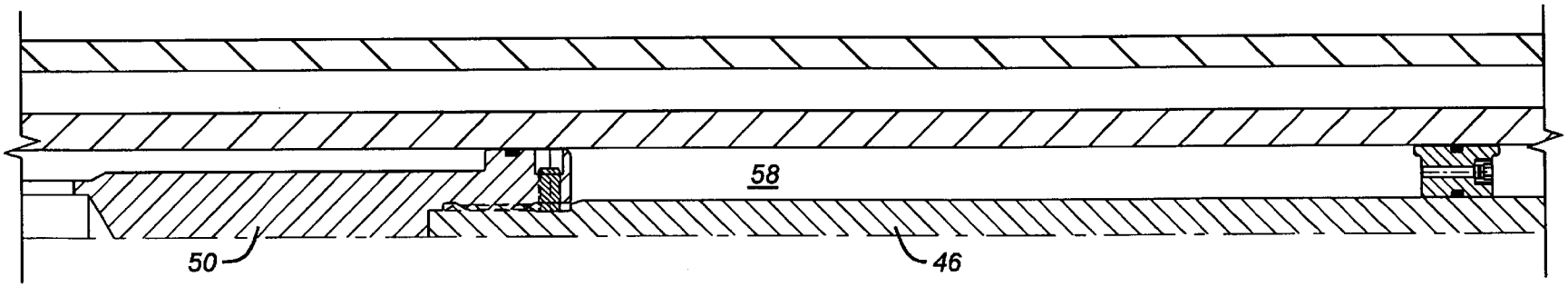
Figure 3D:
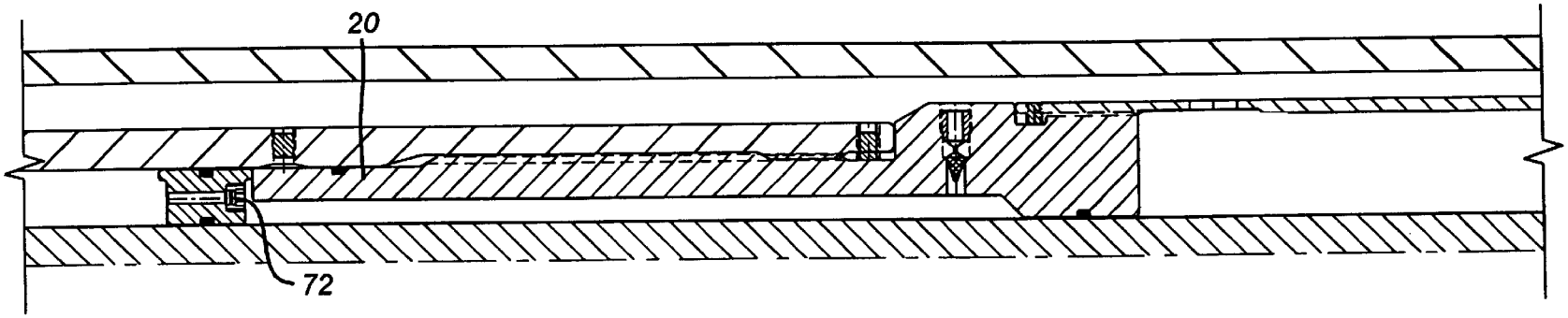
Figure 4D:
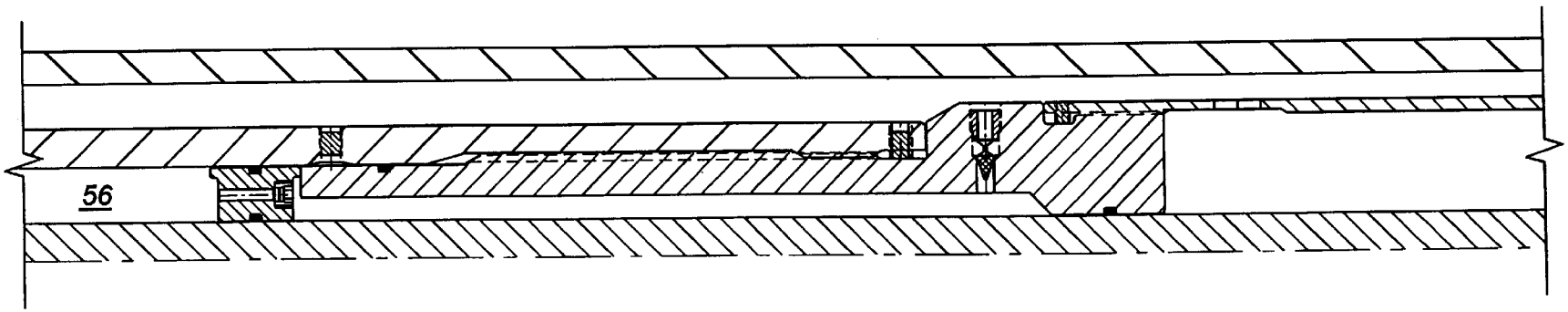
Figure 3E:
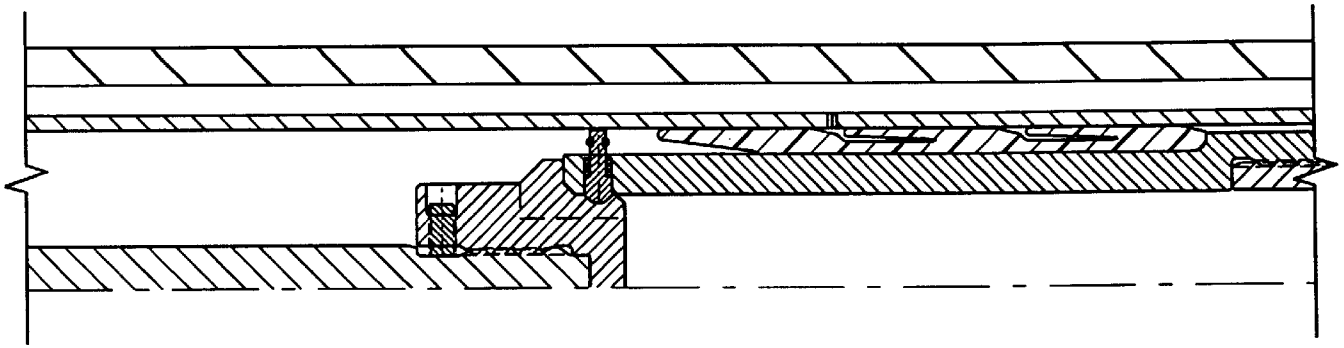
Figure 4E:
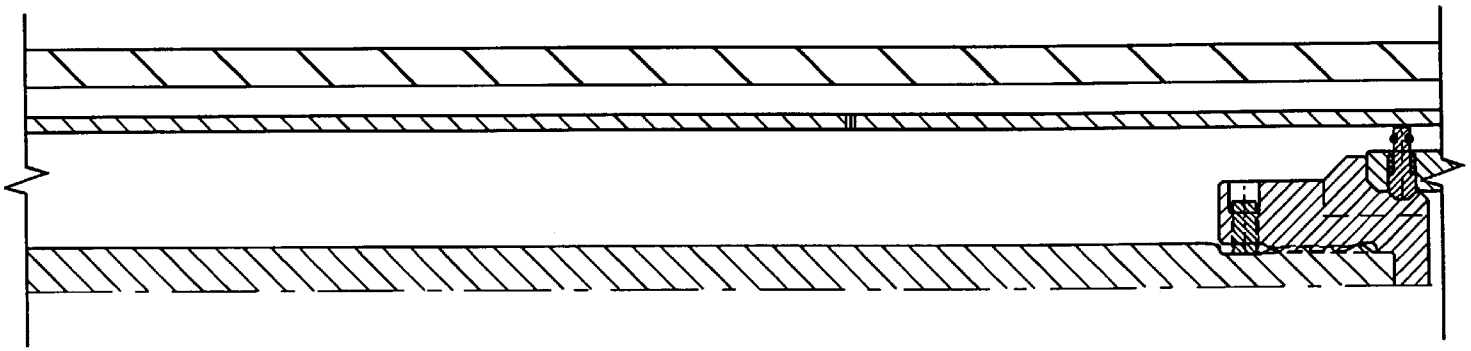
Figure 3F:
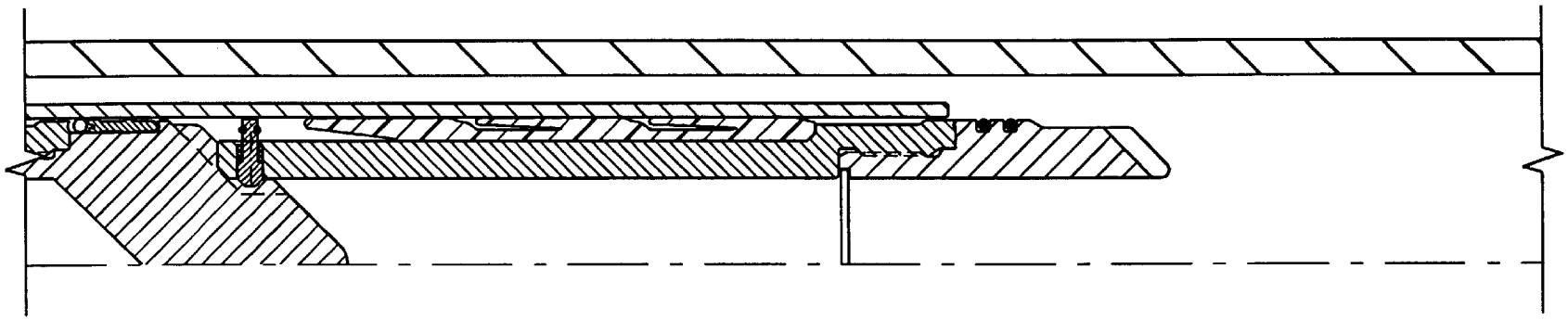
Figure 4F:
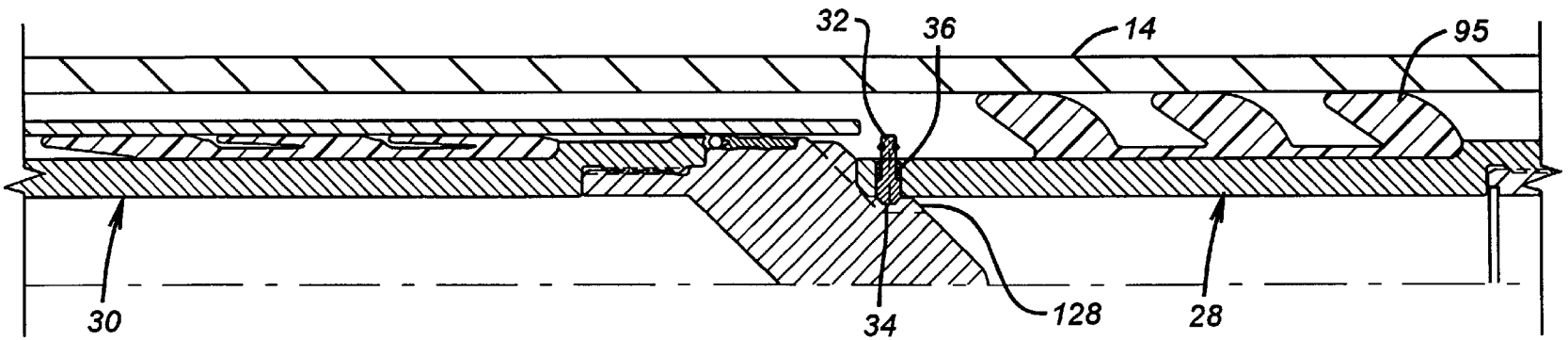
Figure 3G:
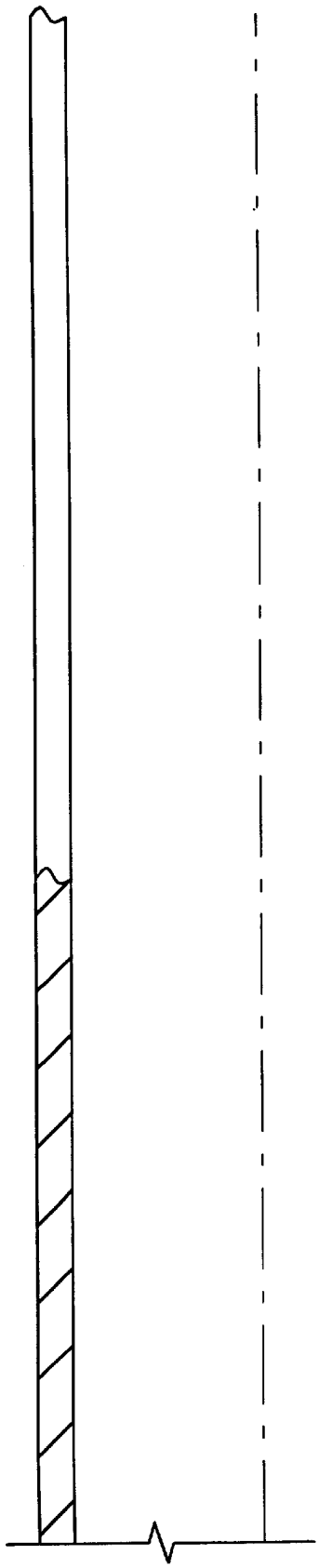
Figure 4G:
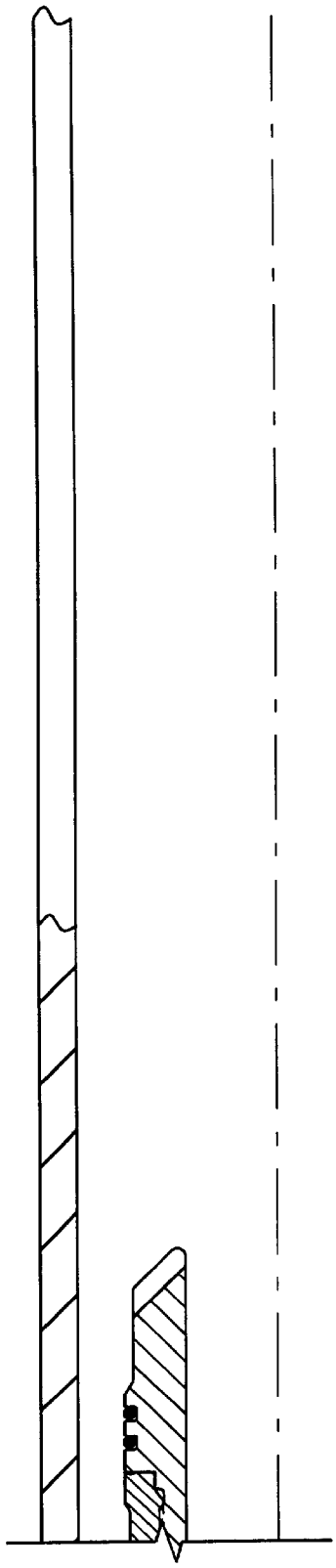
Figure 5A:
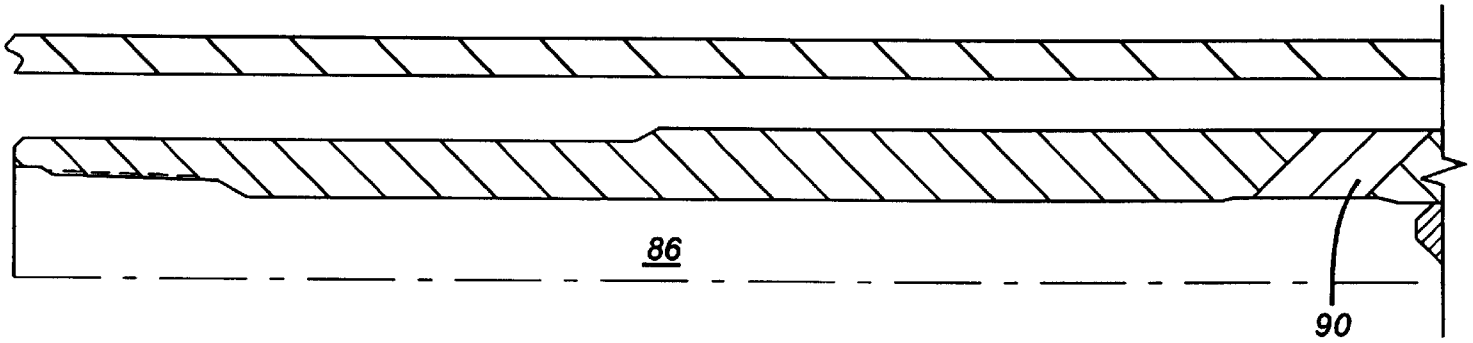
FIGS. 5*a–g* illustrate the first wiper plug going to the cementing shoe, followed by cement from an exposed lateral opening in the tool.
Figure 6A:
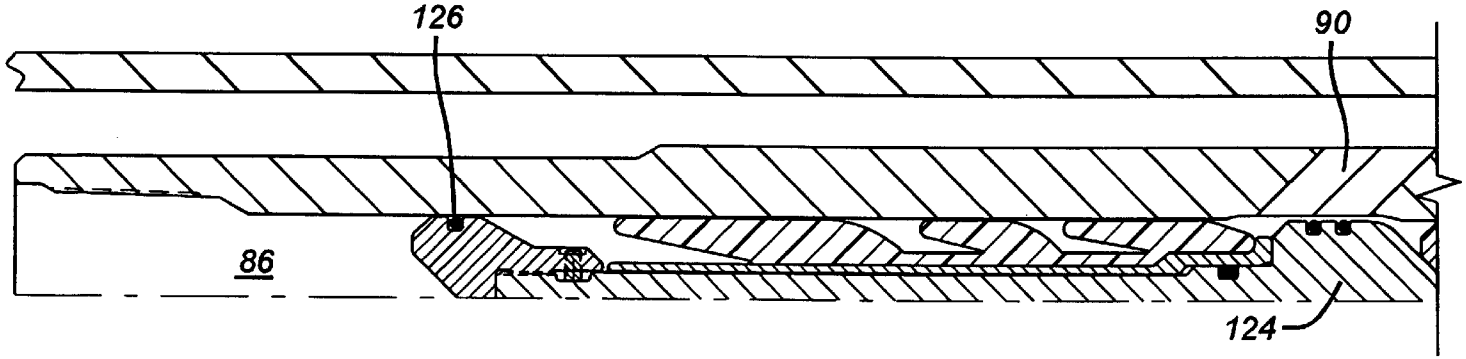
FIGS. 6*a–g* illustrate the dropping of a second dart, obstructing the lateral opening in the tool.
Figure 5B:
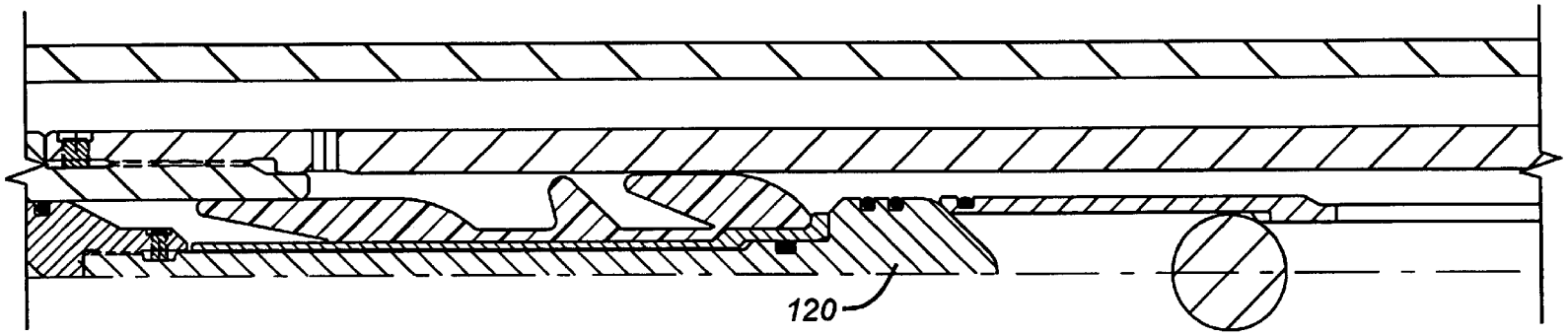
Figure 6B:
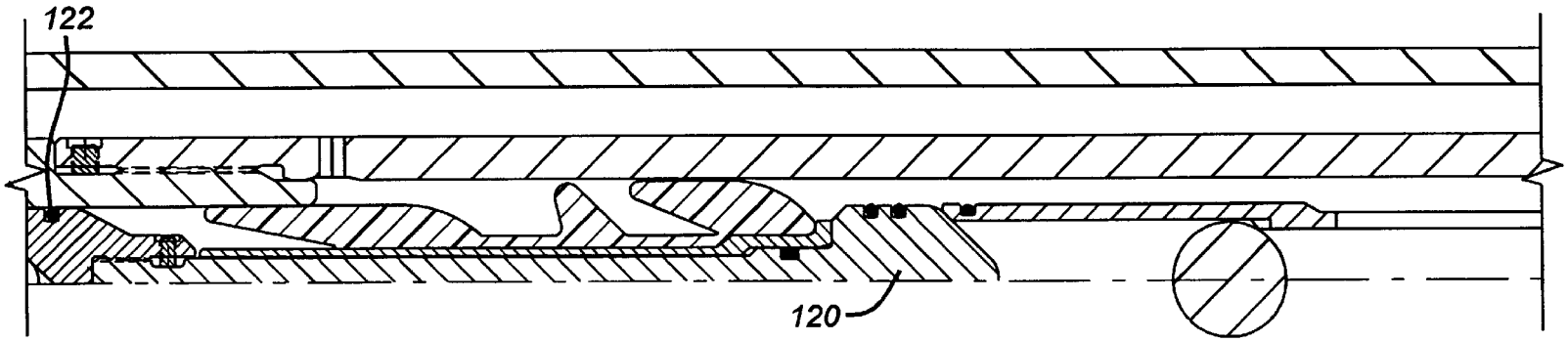
Figure 5C:
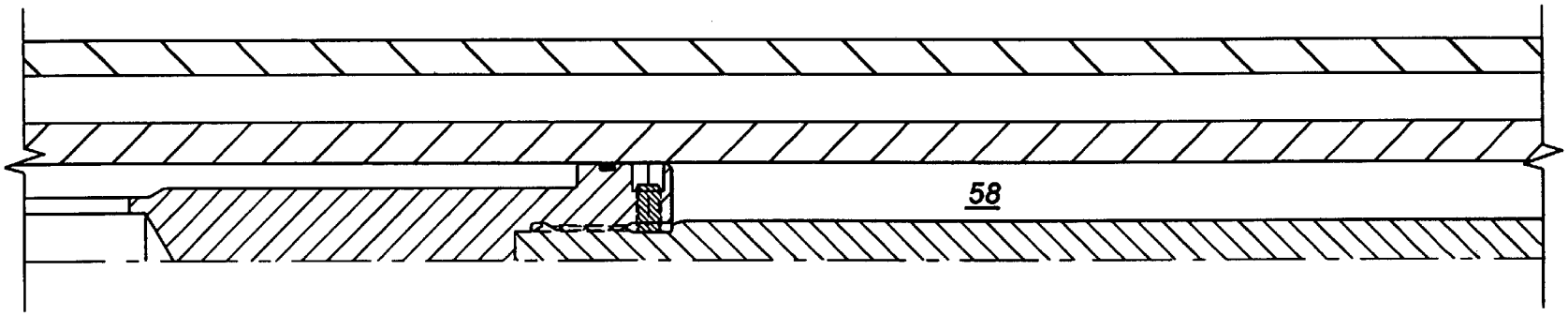
Figure 6C:
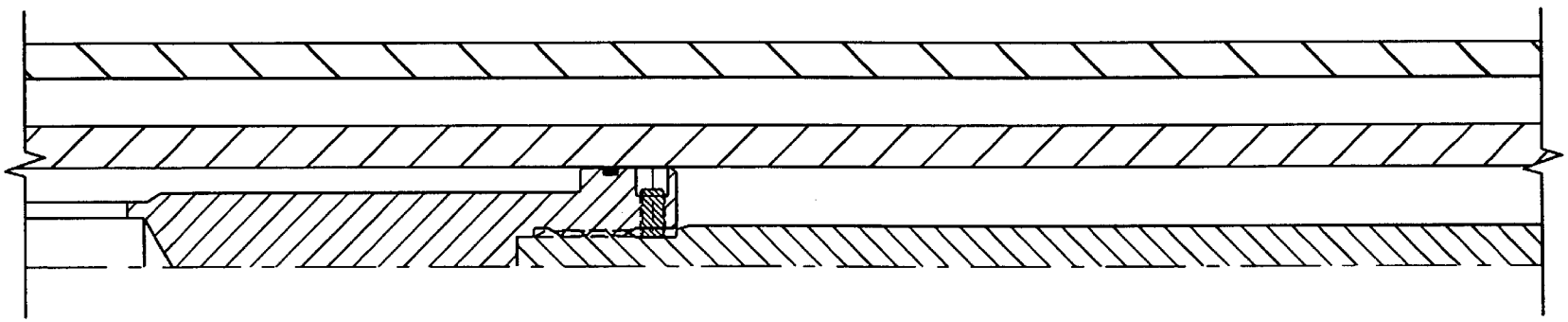
Figure 5D:
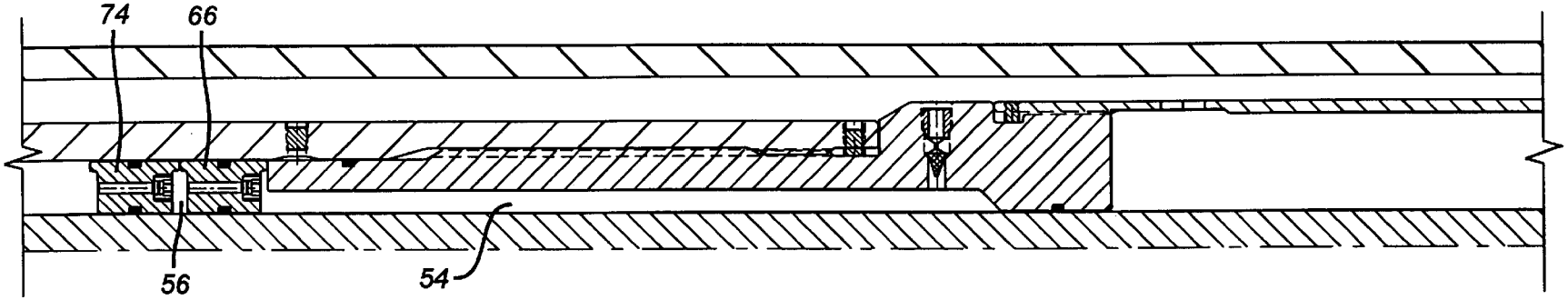
Figure 6D:
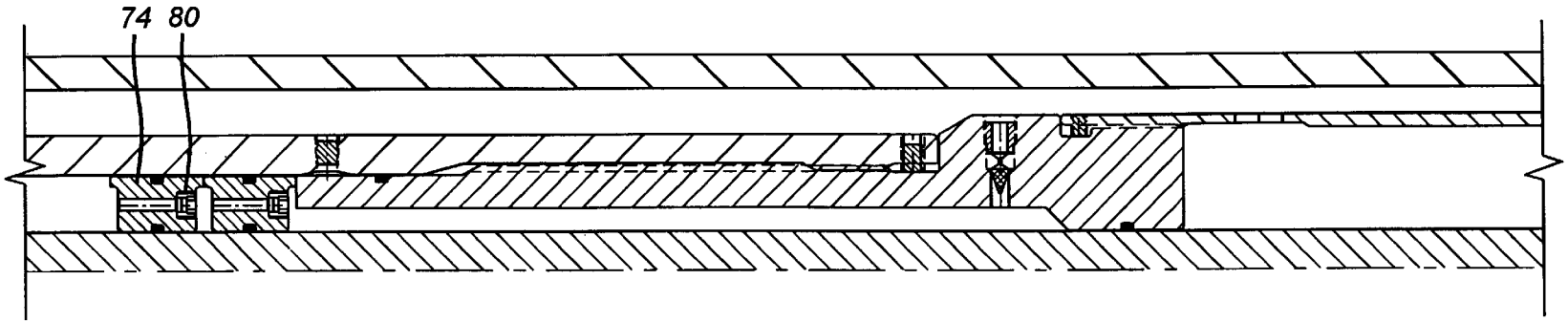
Figure 5E:
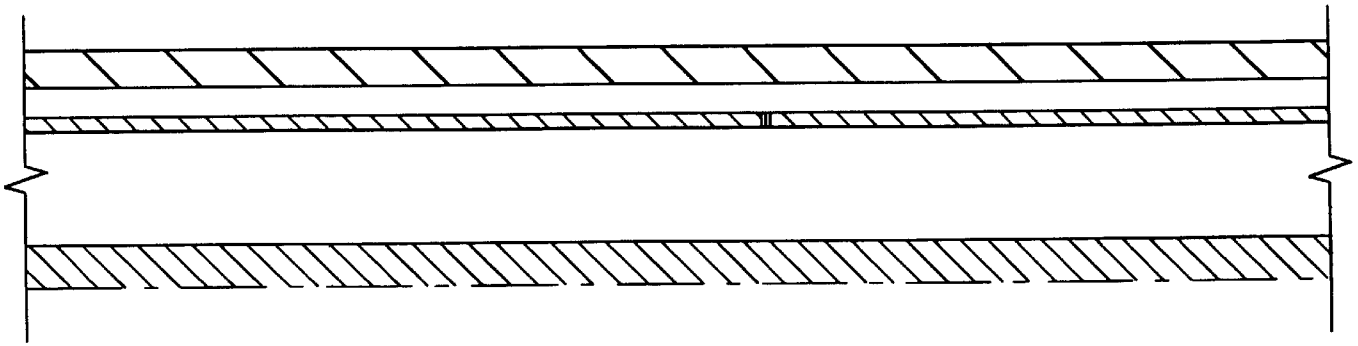
Figure 6E:
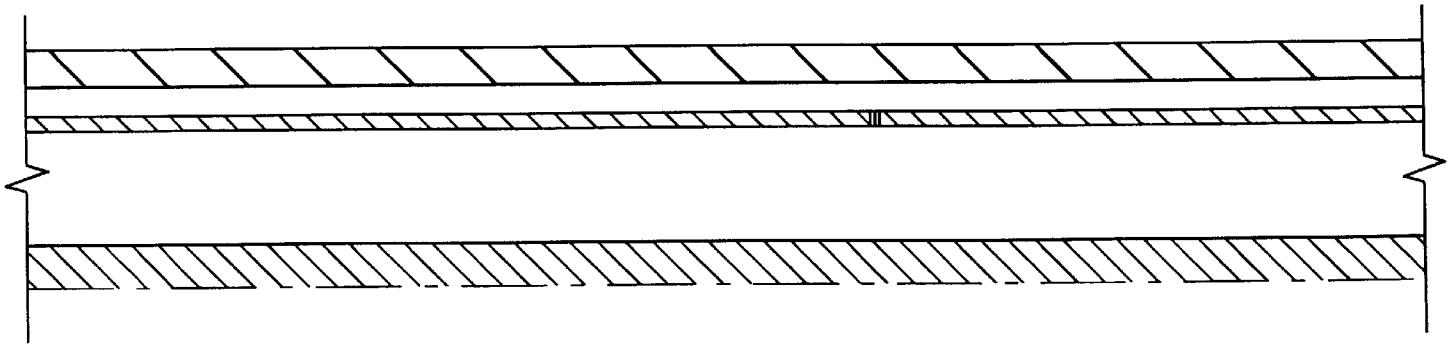
Figure 5F:
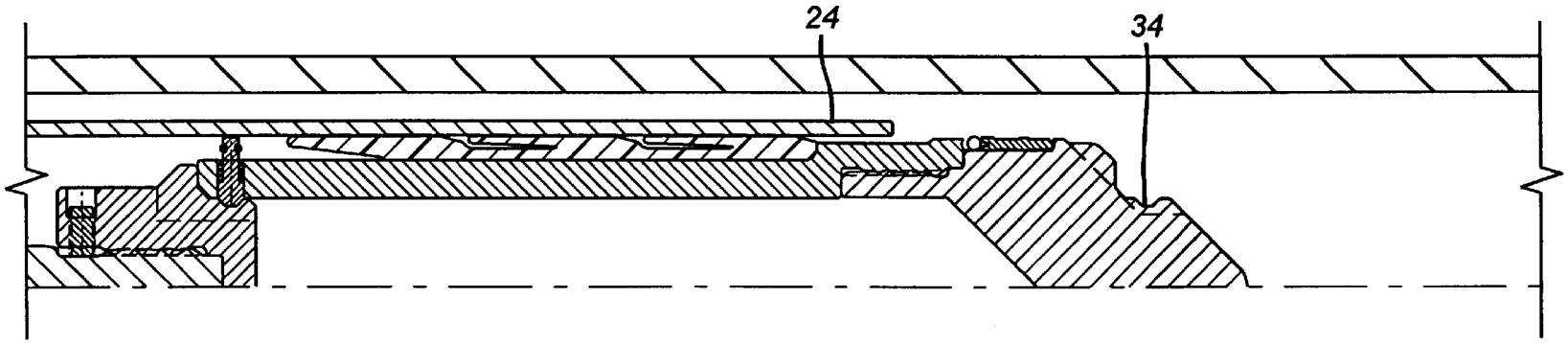
Figure 6F:
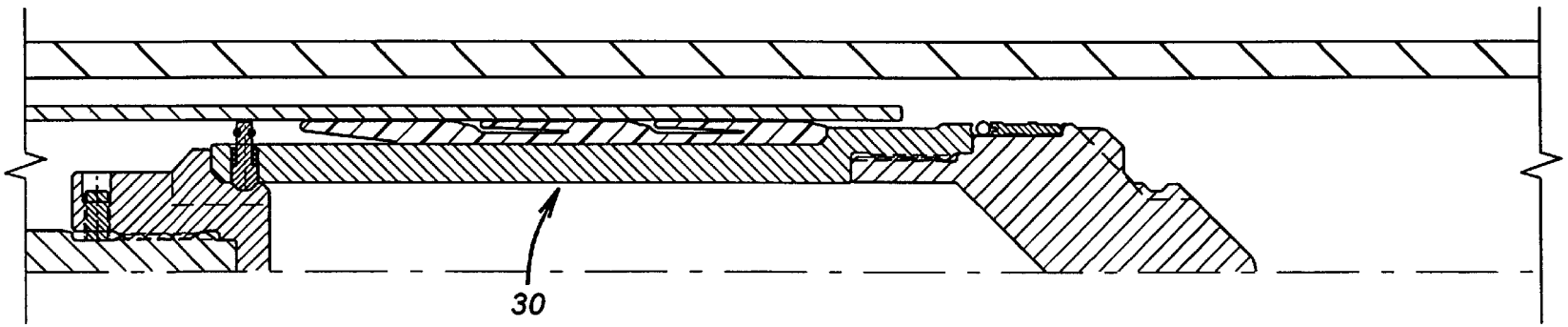
Figure 5G:
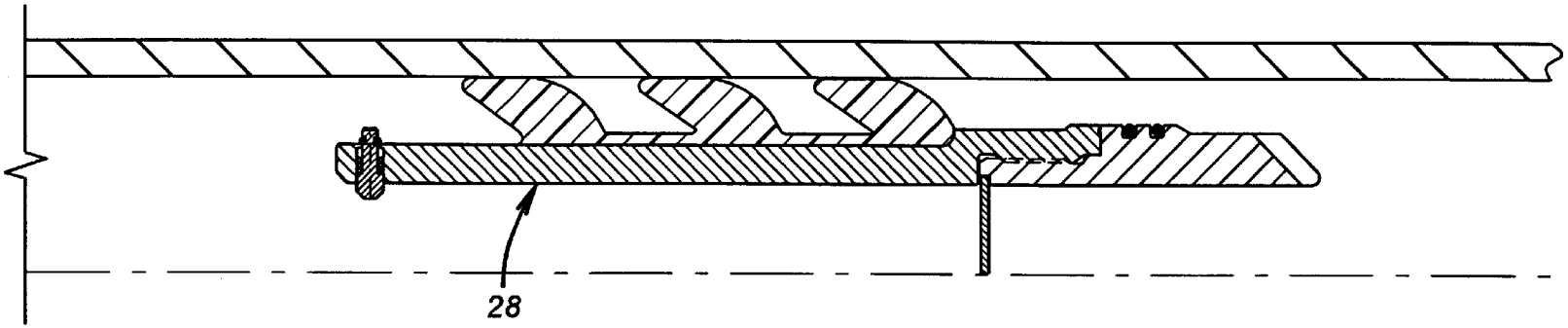
Figure 6G:
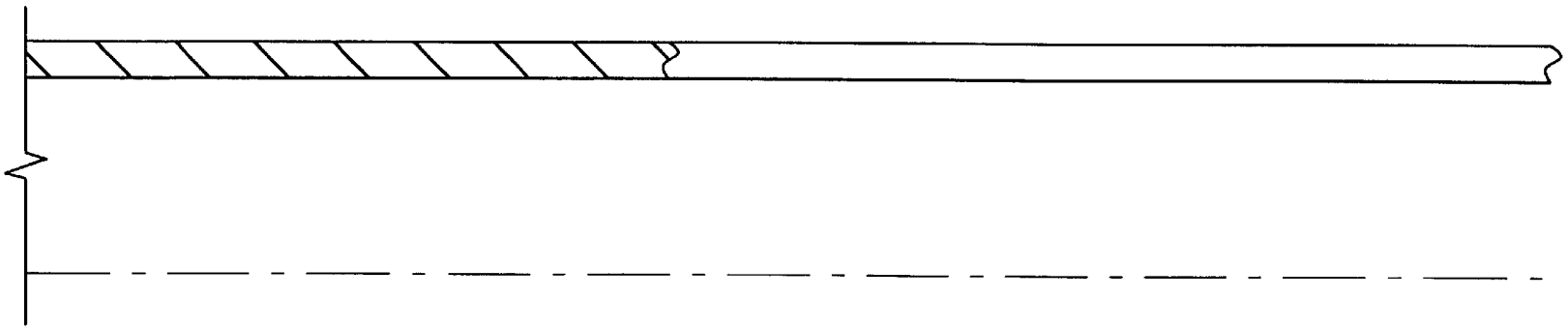
Figure 8A:
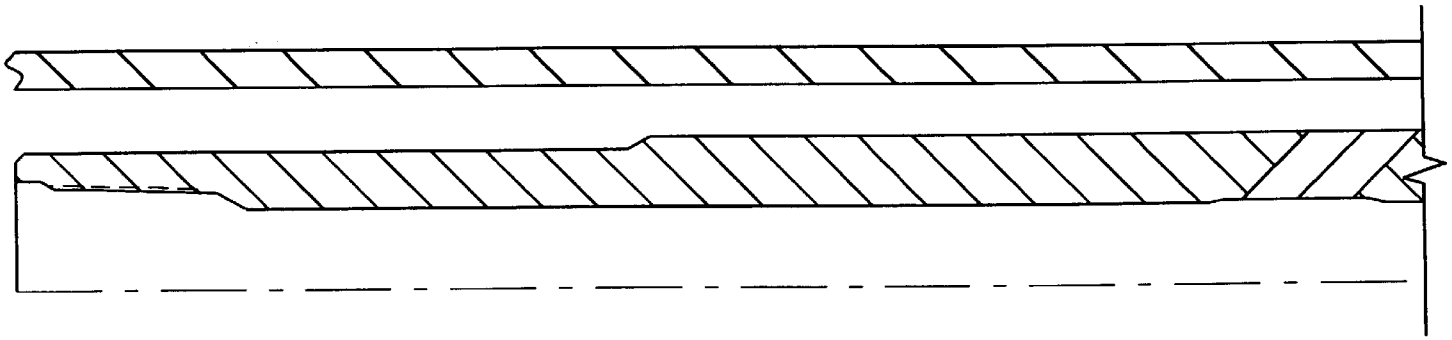
FIGS. 8*a–h* illustrate the second wiper plug being released from the tool and landing on the first wiper plug near the cementing shoe.
Figure 8B:
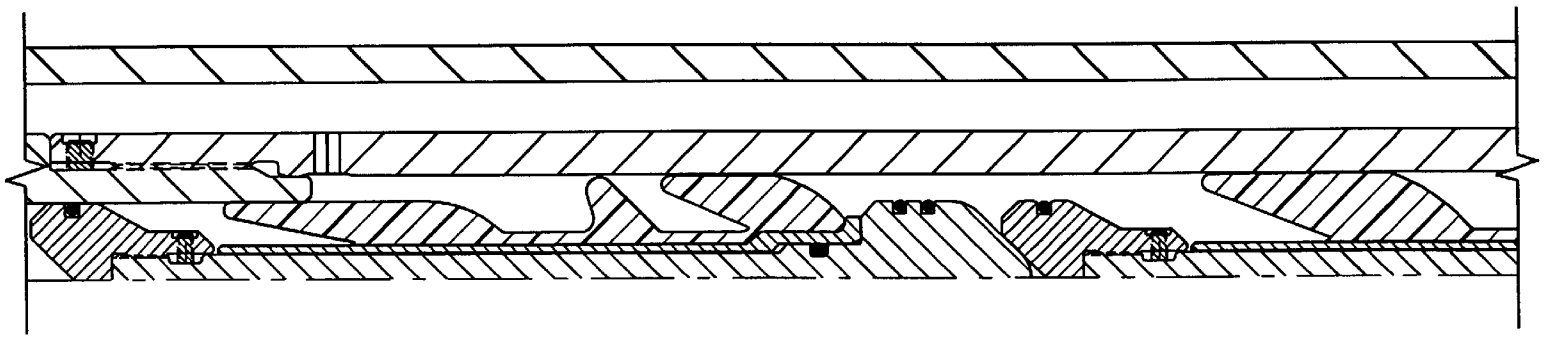
Figure 8C:
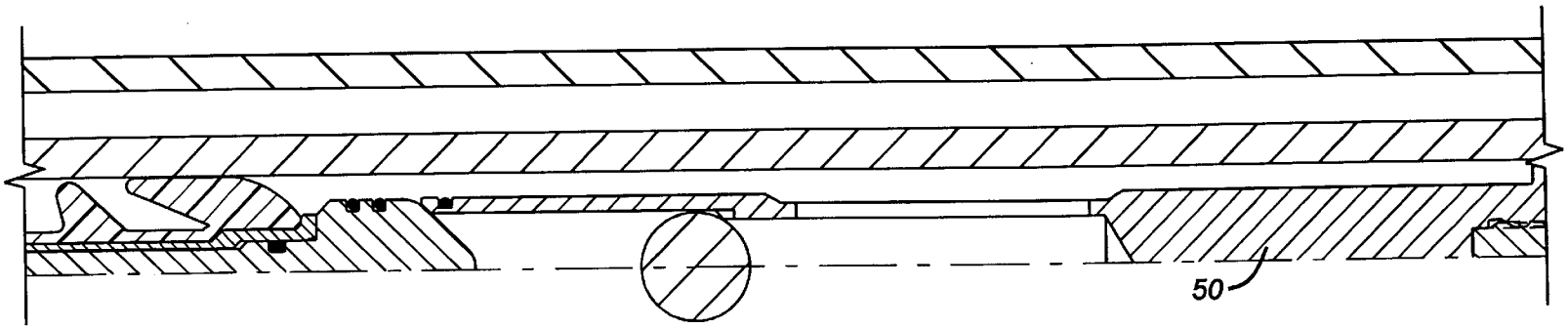
Figure 8D:
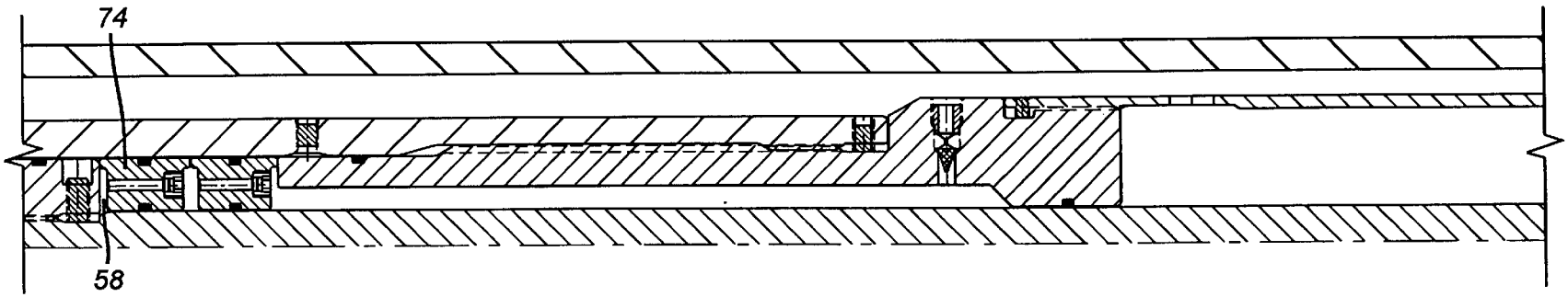
Figure 8E:
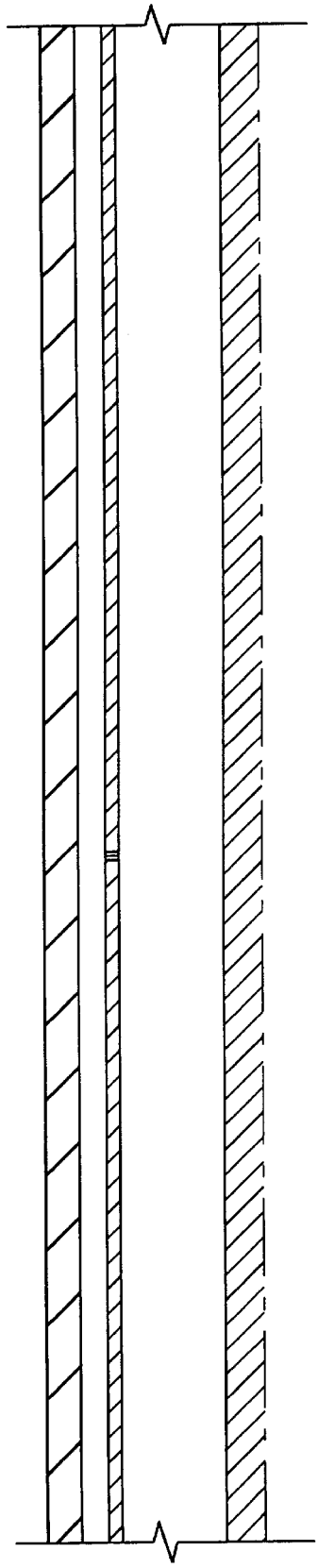

Referring to FIGS. 3*a* and *b*, a dart 120, having a seal 122, is pumped into contact with actuating piston 50. This can happen because the movement of actuating piston 50, shown in FIG. 2*b*, has left port 90 exposed due to the top of actuating piston 50 moving past it. Thus, dart 120 again obstructs passage 86, allowing for further pressure buildup which will move dart 120 and actuating piston 50 in tandem. When the pressure is increased in passage 86, the pressure is further increased to the point where rupture disc 72 in the now-shifted piston 66, will break because it now can see a pressure difference in view of breakage of rupture disc 65 and piston 66 hitting its travel stop. It should be noted that breaking of rupture disc 65, coupled with a reduction in volume of cavity 54, has been accomplished by displacing piston 66 to the position shown in FIG. 2*d*. In any event, a buildup in pressure above dart 120 in passage 86 will result in breakage of rupture disc 72 and displacement at a controlled rate of fluid from cavity 56, whose volume will now decrease as floating piston 74 is to be displaced toward piston 66, which has now bottomed against bottom sub 20. Thus, FIGS. 3*a–f* illustrate the onset of pressure buildup which breaks rupture disc 72, while in FIGS. 4*a–f*, the assembly including the dart 120, actuating piston 50, shaft 46, and wiper plugs 28 and 30, have all shifted downwardly. At this point, as shown in FIGS. 4*f–g*, wiper plug 28 is now below the sleeve 24, allowing the inward bias of spring 36 on the pin 32 to be overcome as pressure forces pin 32 out of groove 34, overcoming the bias of spring 36. As the wiper plug 28 emerges from sleeve 24, the wiping elements 95 spring outwardly to seal off against the liner 14. In a position shown in FIG. 4*f*, the wiper plug 28 is in the position for imminent release, which is shown more clearly in FIG. 5*g*. The difference between FIGS. 4 and 5 is that in FIG. 5, the movable piston 74 has concluded its movement and bottomed on piston 66. As shown in FIG. 5*g*, the wiper plug 28 is now clear of sleeve 24 and is launched in advance of cement or other sealing material which can now be pumped through passage 86 through port 90, which is again exposed when dart 120 clears seal 122 past port 90. Surface personnel will know that the wiper plug 28 has been launched when they see a sudden decrease in pressure as seal 122 of dart 120 moves past port 90. The same kind of signal will also be seen when actuating sleeve 50 has been pushed sufficiently far to break rupture disc 65. This will occur because of a sudden pressure decrease as seal 92 of the actuating sleeve 50 clears past port 90, as shown by comparing FIGS. 1*a* and *b* with FIGS. 2*a* and *b*.

It should be noted that any mechanism that releases upon movement of the plugs 28 and 30 is within the scope of the invention. Sleeve 24 can have an internal ramped recess which will release a plug 28 even before it fully clears sleeve 24. Pins can move to the bottom of a slot at which point they shear off, releasing the plug. As long as the movement is regulated, a variety of release techniques that actuate with movement can be used.

Figure 8F:
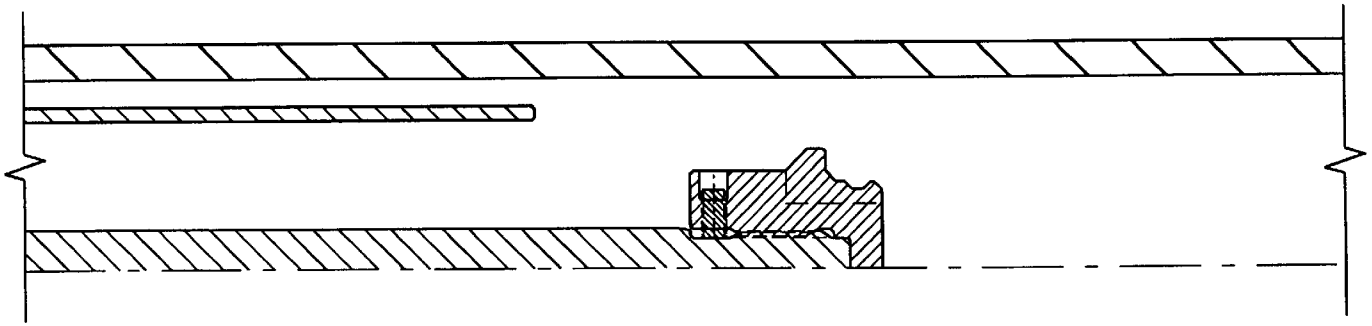
Figure 8G:
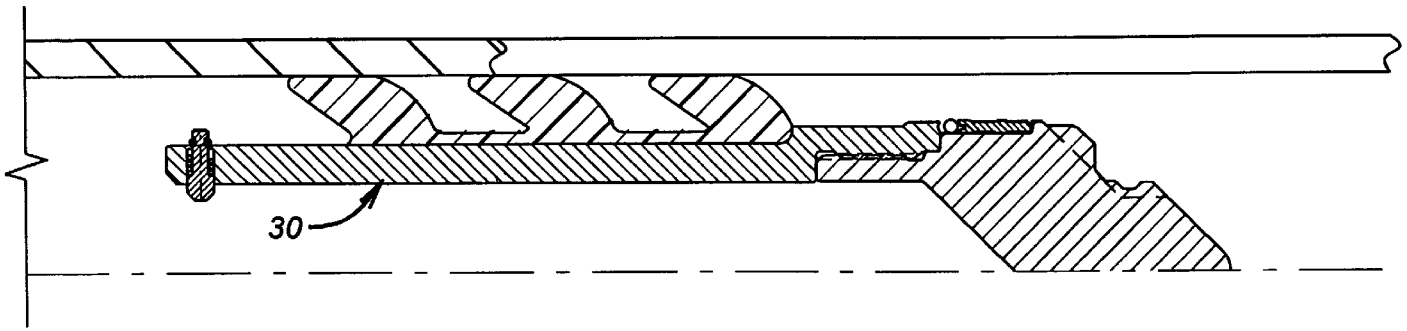
Figure 8H:
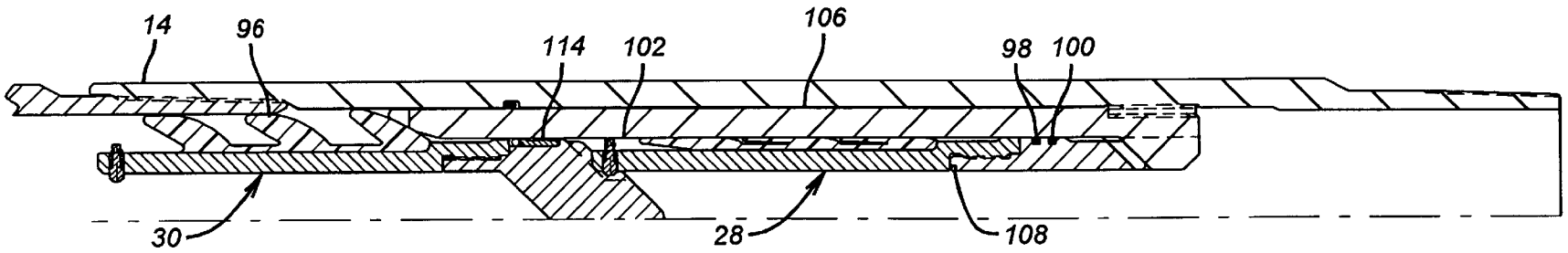

Accordingly, at the conclusion of the steps shown in FIG. 5, the wiper plug 28 has been successfully launched and is now being displaced downhole ahead of the cement or other sealing material which is being pumped through passage 86 and port 90. Eventually, as shown in FIG. 8*h*, the wiper plug 28 lands in bore 102 of stop ring 106. At this time the pressure buildup of the pumped cement will break the barrier 108 to allow the cement to proceed through the cementing shoe and up around the outside of the liner 14 to cement it. It should be noted that at this time the wiper plug 30 is not yet in position, and those skilled in the art will appreciate that FIG. 8*h* is the final position after cementing is concluded and wiper plug 30 is launched, as will be described below. However, for continuity as to the positioning of wiper plug 28, its ultimate position downhole is referred to at this time by directing the reader's attention to FIG. 8*h*.

To conclude the cementing operation, it is desired to launch the wiper plug 30 from its retained position within sleeve 24 to displace cement from the liner. A second dart 124, shown in FIG. 6, is dropped on top of the first dart 120. Again, this obstructs the port 90 by virtue of seal 126. Pressure applied to passage 86 displaces the actuating piston 50 and breaks the rupture disc 80 in piston 74. When rupture disc 80 breaks, the volume of cavity 58 can be reduced, which in turn allows the shaft 46, driven by actuating piston 50, to push the wiper plug 30 beyond sleeve 24. Again, the process is repeated as pin 38 is forced out of groove 42 against the bias of spring 40 by pressure from uphole. The wiping elements 96 expand to obstruct the inside diameter of liner 14. The downward movement of wiper plug 30 terminates as shown in FIG. 8*h* when it hits wiper plug 28. At this time, the seal 114 is in bore 102 and all of the cement pumped ahead of wiper plug 30 is now displaced around the cementing shoe and around the outside of liner 14. It should be noted that the wiping elements 96 do not enter into bore 102 of stop ring 106, but may seal internally in liner 14. The main seal, however, for the wiper plug 30 is the bullet seal 114.

Figure 7A:
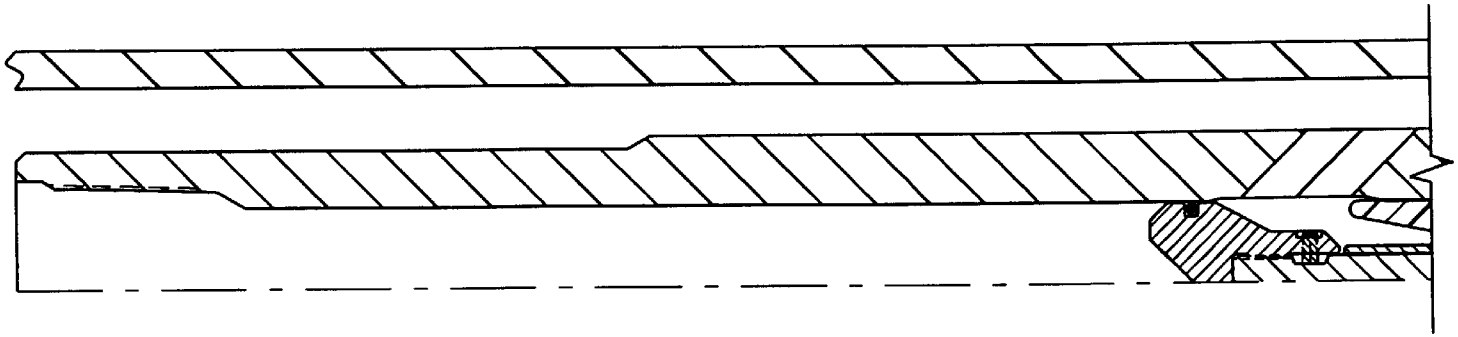
FIGS. 7*a–g* illustrate further shifting of the actuating sleeve by pressure on the second dart to release the second wiper plug after cementing has concluded.
Figure 7B:
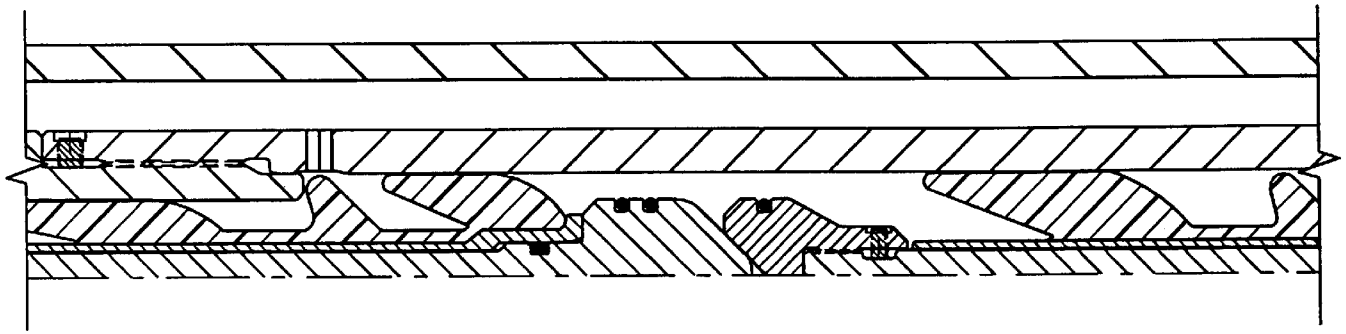
Figure 7C:
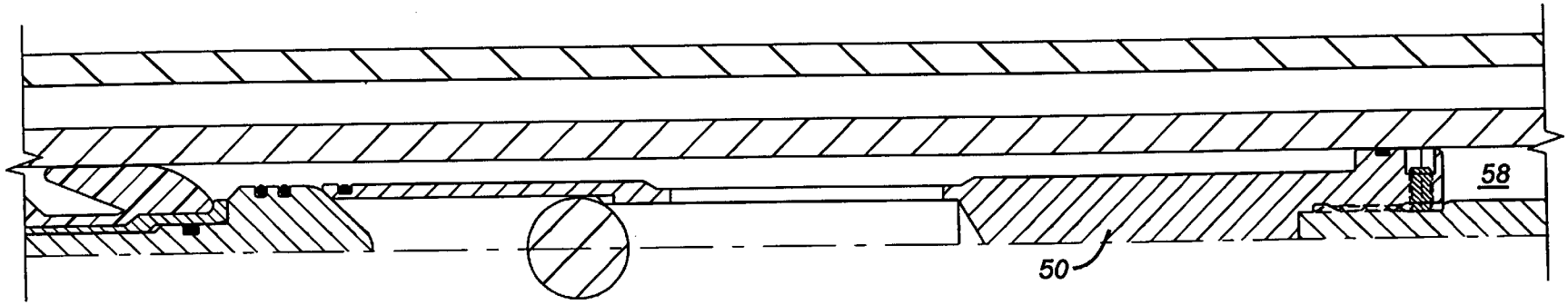
Figure 7D:
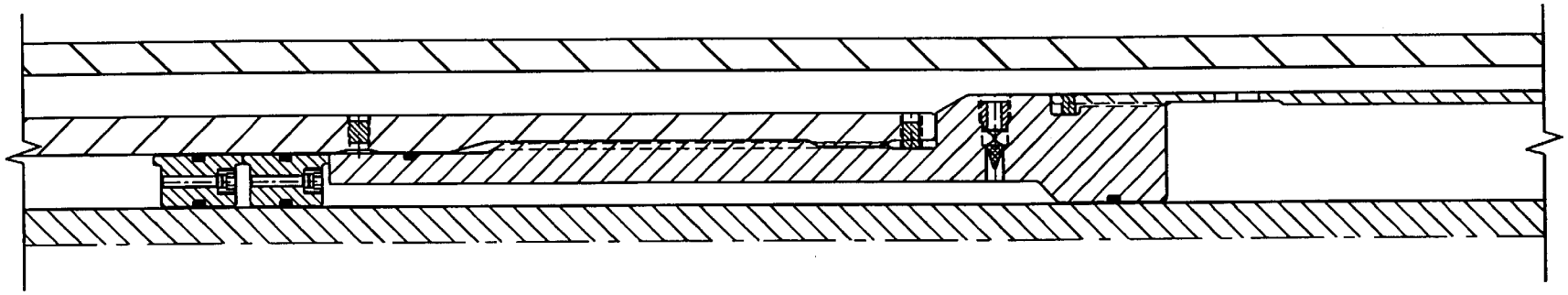
Figure 7E:
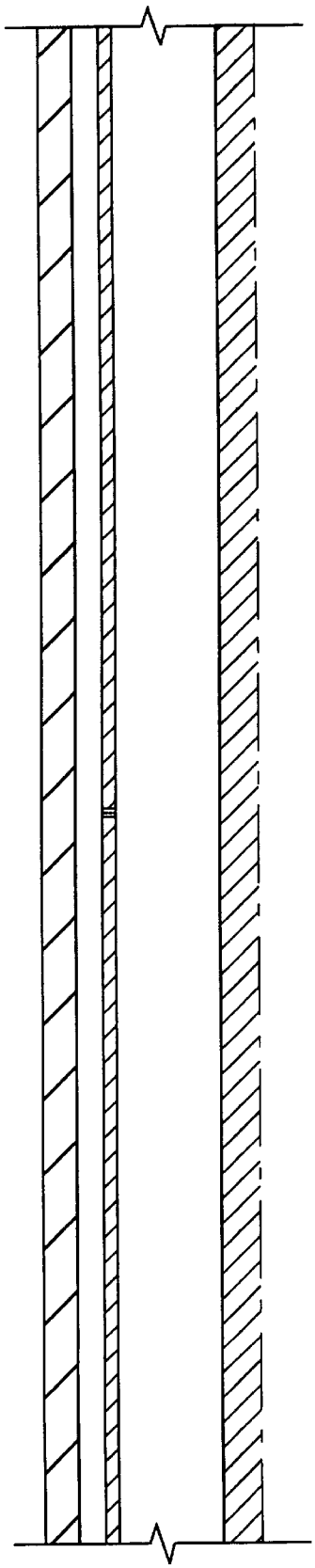
Figure 7F:
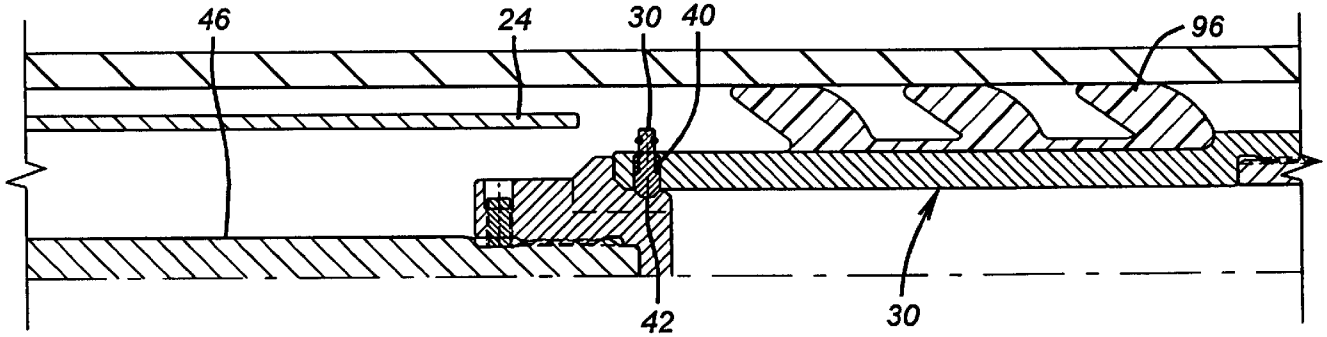
Figure 7G:
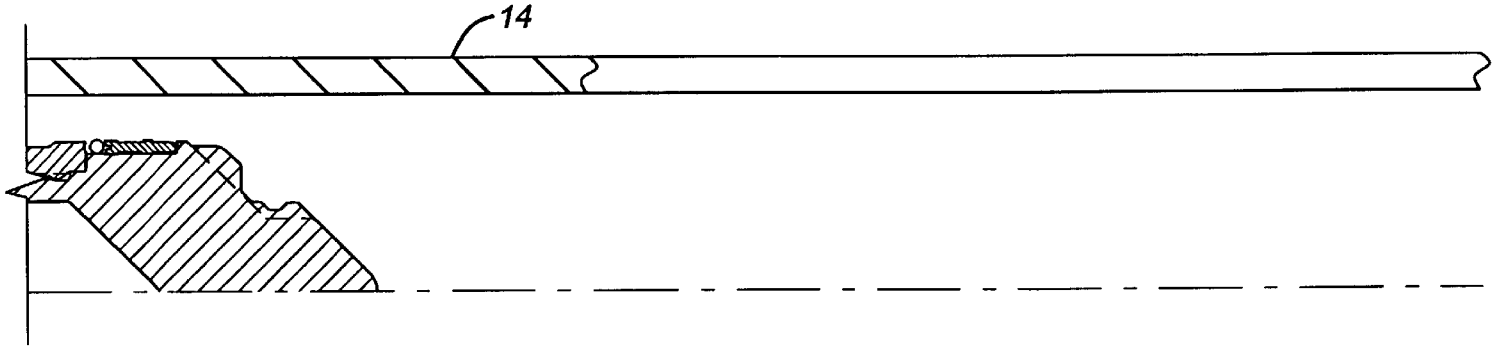

If for any reason the wiper plug 28 when in the position of FIG. 4*f* does not release, pressure applied in passage 86 when port 90 is ultimately exposed will act on the now-expanded wiper elements 95 such that the force put on the wiper plug 28 will either shear the pin 32 or instead, shear a portion 128 of the wiper plug 30 which presents immediately below the groove 34. In either event, by application of sufficient fluid force to the wiper plug 28, if it hasn't already released when extended out of sleeve 24, a release can still be accomplished as a backup measure should the pin 32 fail to clear groove 34. A similar technique can be applied to wiper plug 30 if, in the position shown in FIG. 7*f*, it still fails to release from groove 42.

Those skilled in the art will appreciate that any number of wiper plugs, such as 28 and 30, can be launched from the plug-launching tool T. The successive of movements required to launch additional wiper plugs can be accommodated with the addition of further movable pistons, such as 66 and 74, so that additional steps of movement can be coordinated from the surface by virtue of dropping additional darts, such as 120 and 124, to conclude the additional movements necessary to put any number of plugs outside the sleeve 24 in a desired sequence. All the darts are retained in the tool and are not launched with a wiper plug. In that way they do not have to be drilled out after cementing.

The advantage of the rupture disc 65 is that all the movements can occur at predetermined pressures and will occur fairly gradually as the rate of expulsion of fluid through the outlet port 64 can be regulated by virtue of either an orifice 67 in port 64, or a broken rupture disc 65, or the size of port 64 itself. Surface personnel can more easily tell what is happening since movements downhole are intended to occur at particular applied pressures. Thus, surface personnel can see through pressure changes at the surface that the requisite next move of the tool T downhole has occurred. With the use of rupture discs 72 and 80, each of the desired steps occurs at predetermined pressures, while the rate that each step is accomplished is regulated through the ability of the displaced fluid to escape through the opening provided by a broken rupture disc 65. The formation is not shocked by sudden movements and the apparatus works more smoothly due to its gradual movements. The design is compact by employing an elongated series of cavities which ultimately communicate with each other through the breakage of rupture discs located in movable pistons. The actuation of the plugs using darts now involves a separation by way of the actuating piston so that the darts can be retained and the movement which releases the plugs can be controlled. While the preferred embodiment is for dropping wiper plugs, any object that can fall downhole can be launched with the disclosed apparatus.

The foregoing disclosure and description of the invention are illustrative and explanatory thereof, and various changes in the size, shape and materials, as well as in the details of the illustrated construction, may be made without departing from the spirit of the invention.

What is claimed is:

1. A tool for delivering any object into a tubular, comprising:

a housing;

at least one object movable in said housing toward said tubular while selectively locked against dropping from said housing by a locking member mounted to said object;

an actuating piston in said housing operably connected to said object to move said object a sufficient amount to defeat said locking member.

2. The tool of claim 1, wherein:

said locking member is held by said housing in a first position to retain said object.

3. The tool of claim 2, wherein:

said locking member goes to a second position to release said object when said locking member is moved clear of said housing.

4. A tool for delivering any object into a tubular, comprising:

a housing;

at least one object movable in said housing while selectively locked against dropping from said housing by a locking member mounted thereon;

an actuating piston in said housing operably connected to said object to move said object a sufficient amount to defeat said locking member;

said locking member comprises a biased pin held in a depression in said piston whereupon when said pin is moved sufficiently, it can be forced out of said depression to release said object.

5. A tool for delivering any object into a tubular, comprising:

a housing;

at least one object movable in said housing while selectively locked against dropping from said housing by a locking member mounted thereon;

an actuating piston in said housing operably connected to said object to move said object a sufficient amount to defeat said locking member;

said piston retained against movement until at least one predetermined force is applied to it, whereupon its subsequent movement is at a predetermined regulated rate.

6. The tool of claim 5, wherein:

said piston defines a variable-volume fluid cavity in communication to an outlet port in said housing;

said outlet port selectively obstructed by a rupture disc which ruptures at a predetermined pressure applied to the fluid, whereupon movement of said piston is regulated by the flow restriction through said outlet port.

7. The tool of claim 6, wherein:

said cavity comprises at least one floating piston dividing said cavity into a plurality of sub cavities separated by said floating piston;

whereupon a plurality of discrete movements of said piston can be achieved as said rupture disc is broken first to allow said floating piston to move;

said at least one floating piston further comprises a second rupture disc which when broken allows further regulated movement of said actuating piston.

8. A tool for delivering any object into a tubular, comprising:

a housing;

at least one object movable in said housing while selectively locked against dropping from said housing by a locking member mounted thereon;

an actuating piston in said housing operably connected to said object to move said object a sufficient amount to defeat said locking member;

said at least one object comprises at least two wiper plugs mounted, one above the other, the lowermost plug selectively locked in said housing to said plug above, which plug is also selectively locked in said housing to said actuating piston so that said plugs can move in tandem for sequential release.

9. The tool of claim 8, wherein:

said movement of said piston is staggered to selectively move said lowermost plug to a position where said locking member on said lowermost plug releases it from said plug above it.

10. The tool of claim 9, further comprising:

a first dart to engage said actuating piston and cover a port in said housing above said actuating piston;

said piston defining a fluid cavity in said housing with a selectively sealed outlet;

said actuating piston having its rate of movement restricted when said selectively sealed outlet is opened;

said first dart moving in said housing sufficiently to release said lowermost plug and to expose said port in said housing, thus allowing a sealing material for the tubular to be pumped behind said lowermost plug.

11. The tool of claim 10, further comprising:

a second dart to cover said opening in said housing and selectively move said actuating piston and the next plug at a regulated rate due to fluid displacement, through said now-opened, selectively sealed outlet so that said locking member on said second plug is defeated to release said second plug into the tubular behind the sealing material.

12. The tool of claim 8, further comprising:

a plurality of darts selectively placed into and retained in said housing to force said actuating piston into a series of movements for selective sequential release of said wiper plugs.

13. The tool of claim 12, wherein:

said actuating piston defining a fluid-filled cavity divided by a plurality of floating pistons, each having a bore and a rupture disc in said bore, which opens a bore in one floating piston sequentially from another rupture disc in another floating piston to create discrete movements of said actuating piston regulated by sequential breaks of said rupture discs as fluid is expelled from said cavity.

14. The tool of claim 13, further comprising:

an outlet to said cavity with its own rupture disc to define the initial regulated movement of said actuating piston and to further regulate subsequent fluid displacement out of said cavity and therefore regulate movement of said actuating piston as each said floating piston moves;

said housing further comprising a ball seat on said piston for initial pressure buildup in said housing for operation of other downhole tools and to build pressure which breaks said rupture disc in the outlet of said cavity.

15. A tool for delivering any object into a tubular, comprising: a housing;

at least one object movable in said housing while selectively locked against dropping from said housing by a locking member mounted thereon;

an actuating piston in said housing operably connected to said object to move said object a sufficient amount to defeat said locking member;

said piston defining a fluid cavity in said housing with a selectively sealed outlet;

said outlet on said cavity selectively sealed by a first rupture disc;

at least one pressure-balanced floating piston in said cavity having a bore therethrough selectively obstructed by a second rupture disc;

whereupon at least two discrete regulated movements of said actuating piston are accomplished as said first rupture disc breaks and said floating piston bottoms in said cavity and when said second rupture disc breaks due to said floating piston no longer being in pressure balance, allowing further volume reduction in said cavity as said actuating piston makes it second movement at a regulated rate.

16. The tool of claim 15, wherein:

said at least one object comprises a plurality of wiper plugs;

a plurality of pressure-balanced floating pistons are in said cavity, each having a bore and a rupture disc;

whereupon at least three discrete regulated movements of said actuating piston are possible to release a plurality of said wiper plugs.

17. A wiper plug-launching apparatus, comprising:

a housing;

at least one wiper plug selectively locked in said housing;

an actuating piston operatively connected to said wiper plug;

said actuating piston, when displaced in a fluid damped manner, moves said wiper plug sufficiently so that said selective locking is defeated.

18. The apparatus of claim 17, wherein:

said actuating piston is displaced by at least one dart which is retained in the housing after said wiper plug is launched.

19. A wiper plug-launching apparatus, comprising:

a housing;

at least one wiper plug selectively locked in said housing;

an actuating piston operatively connected to said wiper plug;

said actuating piston, when displaced, moves said wiper plug sufficiently so that said selective locking is defeated;

said wiper plug is retained in said housing and released when moved at least in part out of said housing;

said displacement of said actuating piston is fluid-damped.

20. The apparatus of claim 19, wherein:

said actuation piston defines a fluid cavity in said housing, further comprising a plurality of floating pistons whose movement is regulated by an outlet to said cavity;

said outlet initially covered with a breakable member.

21. The apparatus of claim 20, wherein:

each said floating piston further comprises a bore obstructed by a rupture disc where the order of breakage of said rupture discs in said floating pistons is from a lowermost to an uppermost so as to define a series of discrete regulated movements of said actuating piston as each floating piston bottoms followed by having its rupture disc break, which allows movement of the next floating piston above.

* * * * *